US012082629B2

(12) United States Patent
Drynan

(10) Patent No.: US 12,082,629 B2
(45) Date of Patent: Sep. 10, 2024

(54) BACKLESS BRA WITH TRANSFORMABLE CONFIGURATIONS

(71) Applicant: SEXY BACK BRA, LLC, Whitefish, MT (US)

(72) Inventor: Skye Drynan, Whitefish, MT (US)

(73) Assignee: SEXY BACK BRA, LLC, Whitefish, MT (US)

( * ) Notice: Subject to any disclaimer, the term of this patent is extended or adjusted under 35 U.S.C. 154(b) by 74 days.

(21) Appl. No.: 17/695,187

(22) Filed: Mar. 15, 2022

(65) Prior Publication Data

US 2022/0287382 A1 Sep. 15, 2022

Related U.S. Application Data

(60) Provisional application No. 63/161,437, filed on Mar. 15, 2021.

(51) Int. Cl.
*A41C 3/00* (2006.01)

(52) U.S. Cl.
CPC ..... *A41C 3/0078* (2013.01); *A41C 3/0007* (2013.01); *A41C 3/0028* (2013.01)

(58) Field of Classification Search
None
See application file for complete search history.

(56) References Cited

U.S. PATENT DOCUMENTS 3,306,299 A * 2/1967 Paramore ..... A41C 3/0007 450/86
6,086,451 A * 7/2000 Fernandes ..... A41F 15/002 450/86
6,186,861 B1 * 2/2001 Flaherty ..... A41F 15/002 450/86
6,733,362 B2 * 5/2004 Plew ..... A41C 3/00 450/86
D709,670 S * 7/2014 Vericella ..... D2/708
11,019,853 B2 * 6/2021 Drynan ..... A41B 9/002
2010/0192285 A1 8/2010 Ahn
2010/0210178 A1 8/2010 Chang
(Continued)

FOREIGN PATENT DOCUMENTS

JP 10-226904 A 8/1998
KR 20-0485000 Y1 12/2017
KR 20-0486457 Y1 6/2018

OTHER PUBLICATIONS

The above documents were cited in an International Search Report issued on Jun. 30, 2022, a copy of which is enclosed, that issued in PCT Application No. PCT/US2022/020354.

*Primary Examiner* — Gloria M Hale
(74) *Attorney, Agent, or Firm* — Cowan, Liebowitz & Latman, P.C.; Mark Montague; Fei Xing

(57) ABSTRACT

A bra comprising a first cup and a second cup, each of the first and second cups having an outer surface and an inner surface, the inner surface facing a wearer's skin when worn, and each of the first and second cups having an upper edge and a lower edge, a plurality of tabs provided on the inner surface of the first and second cups, each of the tabs being configured for connecting at least one fastener portion thereto. The plurality of tabs include one or more lower tabs formed along the lower edge of the first cup and one or more lower tabs formed along the lower edge of the second cup.

24 Claims, 23 Drawing Sheets

(56) References Cited

U.S. PATENT DOCUMENTS

| | | | | |
|---|---|---|---|---|
| 2013/0084776 | A1* | 4/2013 | Walsh | A41C 3/12<br>450/86 |
| 2017/0347720 | A1 | 12/2017 | Gehlhausen et al. | |
| 2021/0392959 | A1* | 12/2021 | Harp | A41C 3/0028 |
| 2022/0304394 | A1* | 9/2022 | Castillo Piedra | A41C 3/0021 |

* cited by examiner

1000

FIG. 24A
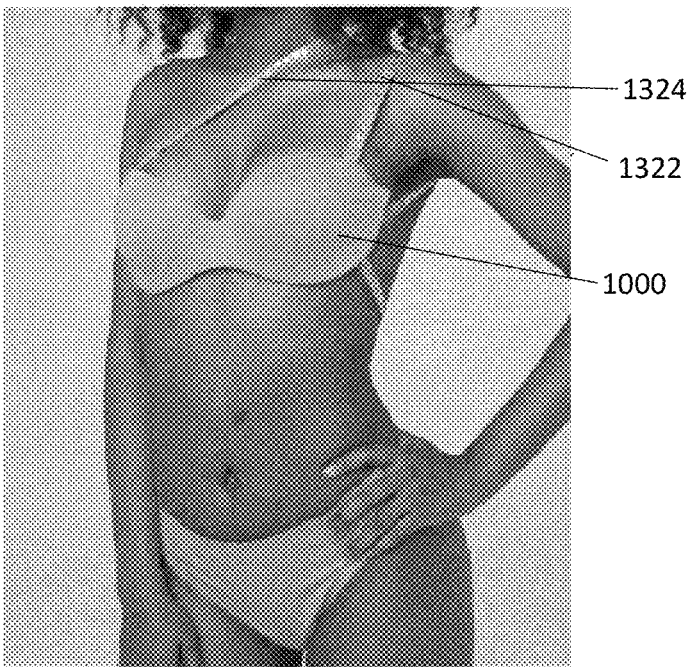
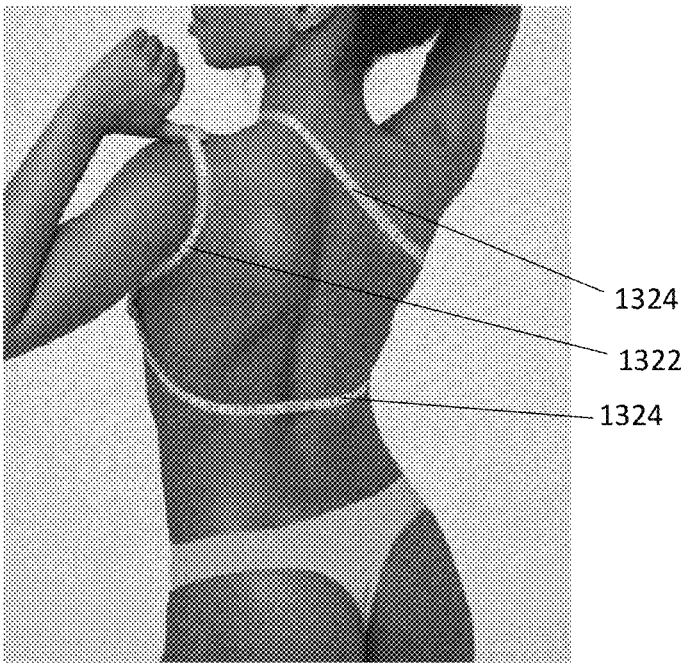
FIG. 24B
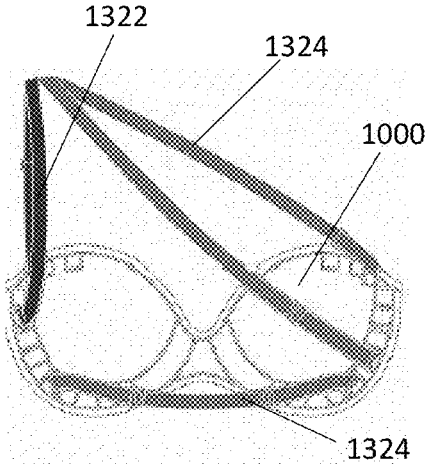
FIG. 24C

BACKLESS BRA WITH TRANSFORMABLE CONFIGURATIONS

REFERENCE TO RELATED APPLICATION

This application claims priority to U.S. Provisional Application Ser. No. 63/161,437, filed on Mar. 15, 2021, which is assigned to the same assignee herein and which is incorporated herein by reference.

FIELD OF THE INVENTION

The present invention relates to undergarments and foundation garments particularly structured and designed to be worn in multiple configurations. More particularly, the present invention pertains to bras that provide support, allow for a mostly or completely unobstructed view of a wearer's back, and include features that enable the bras to be worn in different ways.

BACKGROUND OF THE INVENTION

Traditional women's undergarments, namely brassieres, generally have a front portion with supportive cups, wings extending from the front portion surrounding the wearer's ribcage, a hook and eye closure to connect the two wings, and two shoulder straps. While traditional bras are practical for everyday use under daily wear, such as t-shirt, blouses, sweaters, etc., these traditional bras are not suitable for all purposes, e.g., for wear with backless garments such as formal gowns.

U.S. Design Patent. Nos. D762,944, D793,653, D793,654, D793,655 and D793,656 and U.S. Pat. Nos. 9,750,288 and 11,019,853, which are assigned to the same assignee herein, show and describe backless support bras which include a front main panel, a set of upper shoulder straps connected to the front main panel and a set of lower pelvic straps connected to the front main panel. The backless support bras disclosed in these patents provide an unobstructed view of a wearer's back so that these bras may be worn with revealing and backless dresses.

SUMMARY OF THE INVENTION

The present invention provides an improved backless bra with transformable configurations that can be worn in different manners to accommodate any number of preferred wearing styles, including completely backless, strapless, halter, one shoulder, two shoulder, crisscross, and/or other styles/configurations herein described. In accordance with the present invention, a single bra along with the straps herein described may be employed by the wearer to provide different styles of function and fashion. The present invention further includes additional embodiments and variations thereof, as will be described.

In accordance with the present invention, a bra, such as a backless bra is provided that comprises a first cup and a second cup, each of the first and second cups having an outer surface and an inner surface, the inner surface facing a wearer's skin when worn, and each of the first and second cups having an upper edge and a lower edge, and a plurality of tabs provided on the inner surface of the first and second cups, each of the tabs being configured for connecting at least one fastener portion thereto. The plurality of tabs include one or more lower tabs formed along the lower edge of the first cup and one or more lower tabs formed along the lower edge of the second cup. In some embodiments, each of the lower tabs includes a first end attached adjacent to the lower edge of the respective first and second cup and a second end attached at a predetermined distance away from the lower edge, and each of the upper tabs forms a loop.

In certain embodiments, each of the first and second bra cups includes an underwire extending along the lower edge of the respective first and second cup within an underwire channel. In such embodiments, each of said lower tabs extends across the underwire channel or across a portion of the underwire channel.

In some embodiments, each of the lower tabs forms a pair of loops angled relative to one another and partially overlapping with one another at one end thereof.

In certain embodiments, each of the first and second bra cups includes an outer side corner, and the plurality of tabs include first and second corner tabs formed adjacent to the outer side corners of the respective first and second bra cups. Each of said first and second corner tabs is configured for connecting at least one fastener portion thereto and is also configured to enable the at least one fastener portion to pivot between first and second orientations.

In some embodiments, each of the first and second bra cups includes at least first, second and third lower tabs disposed along the lower edge of the respective first and second bra cup. In such configurations, the first lower tab is adjacent to the second lower tab and the second lower tab is adjacent to the third lower tab, and a first distance between the first lower tab and the second lower tab is different from a second distance between the second lower tab and the third lower tab.

In certain embodiments, the plurality of tabs include one or more upper tabs formed along the upper edge of the first cup and one or more upper tabs formed along the upper edge of the second cup. In some embodiments, the lower tabs and the upper tabs have the same construction. In some variations, each of the first and second bra cups includes at least first, second and third upper tabs disposed along the upper edge of the respective first and second bra cup. In such variations, the first upper tab is adjacent to the second upper tab and the second upper tab is adjacent to the third upper tab, and a first distance between the first upper tab and the second upper tab is different from a second distance between the second upper tab and the third upper tab.

In some embodiments, the bra is a backless bra and does not include side panels or a backband extending from the bra cups. In this way, the bra is configured to provide an unobstructed view of a wearer's back.

The present invention also includes a bra that comprises a first cup and a second cup, each of the first and second cups having an outer surface and an inner surface, the inner surface facing a wearer's skin when worn, and each of the first and second cups having an upper edge and a lower edge, and a plurality of tabs provided on the inner surface of the first and second cups, each of the tabs being configured for connecting at least one fastener portion thereto. In the bra of the invention, each of the first and second bra cups includes an outer side corner, and the plurality of tabs include first and second corner tabs formed adjacent to the outer side corners of the respective first and second bra cups.

In some embodiments, each of the first and second corner tabs is configured for connecting at least one fastener portion thereto and is configured to enable the at least one fastener portion to pivot between first and second orientations. In some variations, each corner tab includes a strap portion having first and second ends attached adjacent to the respective outer side corner and angled relative to one another at an angle greater than 0 degrees and smaller than 180 degrees. In some variations, each corner tab includes a first strap portion attached adjacent to the respective outer side corner and a second strap portion folded over at least a portion of the first strap portion to form a first loop portion. In such variations, a free end of the second strap portion is attached to the bra cup so as to form a second loop portion oriented in a different direction from the first loop portion.

In some embodiments of the bra with the corner tabs, the plurality of tabs also include one or more lower tabs formed along the lower edge of the first cup and one or more lower tabs formed along the lower edge of the second cup.

The present invention also includes a bra assembly comprising a bra as described above, and a body strap including first and second lower straps, wherein each of the first and second lower straps includes at least one fastener portion configured to connect with the one or more lower tabs. In some embodiments, the body strap further includes a gusset connecting portions of the first and second lower straps. In some embodiments of the bra assembly, the plurality of tabs on the bra include at least one of: (a) one or more upper tabs formed along the upper edge of the first cup and one or more upper tabs formed along the upper edge of the second cup; and (b) first and second corner tabs formed adjacent to outer side corners of the respective first and second bra cups, and the bra assembly further includes one or more upper straps. Each of the upper straps includes at least one fastener portion configured to connect with the at least one of the one or more upper tabs and the first and second corner tabs.

The present invention further includes a bra assembly comprising a bra with corner tabs as described above, and one or more upper straps, each of the upper straps including at least one fastener portion configured to connect with one of the first and second corner tabs. In some embodiments, the plurality of tabs include one or more lower tabs formed along the lower edge of the first cup and one or more lower tabs formed along the lower edge of the second cup, and the bra assembly further includes a body strap including first and second lower straps, each of the first and second lower straps including at least one fastener portion configured to connect with the one or more lower tabs.

In the embodiments of the above bra assemblies, the body strap and the one or more upper straps are configured to connect to selected tabs of the plurality of tabs to form different wearing configurations of the bra assembly.

BRIEF DESCRIPTION OF THE DRAWINGS

The above and other features and aspects of the present invention will become more apparent upon reading the following detailed description in conjunction with the accompanying drawings in which:

FIGS. 24A-24C show the backless bra being worn in another "Asymmetrical" configuration using only upper straps.

DETAILED DESCRIPTION OF THE INVENTION

The present application incorporates herein by reference the entire disclosures of U.S. Design Patent. Nos. D762,944, D793,653, D793,654, D793,655 and D793,656 and the entire disclosures of U.S. Pat. No. 9,750,288 and U.S. Patent Application Publication No. 2017/0347720, which are assigned to the applicant hereof. These patents and published application disclose multiple variations of a backless support bra. The present invention represents enhancements and improvements over the backless support bras disclosed in these incorporated documents, and it is appreciated that various embodiments and variations described herein may be applied to each of the versions shown in the incorporated documents.

Figure 1:
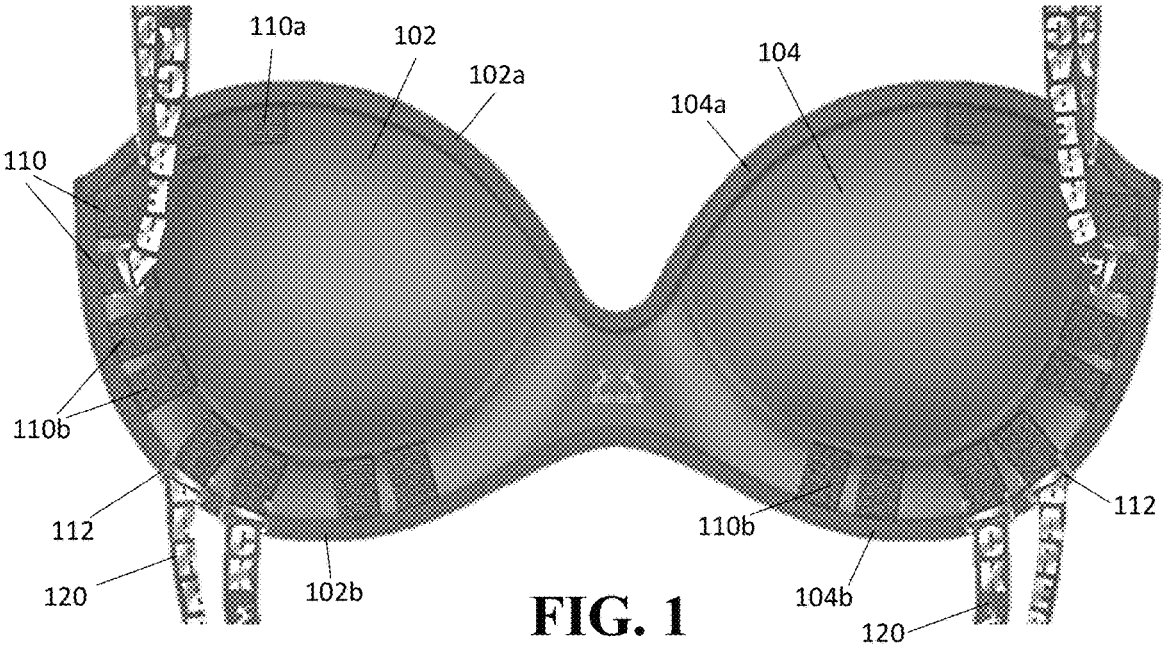
FIG. 1 shows an inner surface structure of a backless bra with transformable configurations of the present invention.

A representative backless bra with transformable configurations in accordance with the present invention is shown in FIG. 1, which shows the inner surface structure of the inventive backless bra 100 with transformable configurations. For convenience, the backless bras with transformable configurations in accordance with the present invention are called herein "the inventive bra," "the backless bra of the present invention," "the transformable bra" and the like, and other terms that are clear in the discussion to be referring to the invention hereof. For further convenience, the backless bra of the present invention is referred to sometimes herein simply as "the backless bra."

As shown in FIG. 1, the inventive backless bra 100 includes a first bra cup 102 and a bra second cup 104, which may be connected by a center front gore 103. In the illustrative embodiment of FIG. 1, the first and second cups 102, 104 are non-releasably connected to each other using the center front gore. In other embodiments, the center front gore may form a detachable connection, such as by using one or more fasteners to connect the first and second cups 102, 104, and/or an adjustable connection configured to allow a wearer to adjust the distance between the first and second cups 102, 104. In yet other embodiments, the cups may be separated from one another, without any center gore. Although the first and second cups are shown as molded full cups, it is understood that the shape of the cups as well as the construction type of the cups may be varied. For example, in some embodiments, the cups may be formed with an embedded underwire while in other embodiments, the cups are formed without any underwire. In some embodiments, the cups may include padding, while in other embodiments, the cups may be unpadded.

As shown, each cup 102, 104 includes an upper edge 102*a*, 104*a* and a lower edge 102*b*, 104*b*. The inner surface or underside of the bra 100 shown in FIG. 1 faces and abuts a wearer's skin when worn and includes a plurality of tabs or loops 110 formed thereon. Specifically, the plurality of tabs or loops 110 are formed along at least a portion of the lower edge 102*b*, 104*b* of each cup 102, 104, and may also include one or more tabs or loops 110 formed along at least a portion of the upper edge 102*a*, 104*a* of each cup 102, 104. In the illustrative embodiment of FIG. 1, each cup 102, 104 includes a set of three upper tabs or loops 110*a* extending substantially vertically along an outer side portion of the upper edge 102*a*, 104*a*, with the outermost tab on each cup 102, 104 being hidden behind a pair of straps, and a set of eight lower tabs or loops 110*b* extending along the lower edge 102*b*, 104*b* of each cup 102, 104 in a direction transverse to the lower edge. At least some of adjacent tabs 110 are positioned closer to one another than to other adjacent tabs, e.g., in pairs, in order to allow straps to connect at closer intervals or at further intervals, thus increasing the possibilities of customization. The tabs 110 may be formed from rigid tape loops, ribbons or from any other suitable strap-like material sufficient to withstand attachment and detachment of fasteners thereto and sufficient to withstand any pulling thereon. The number and positioning of the upper and lower tabs 110*a*, 110*b* may be modified from the exemplary number and positioning shown to customize and adjust the different configurations in which the bra may be worn. In addition, the shape of the tabs 110 in FIG. 1 is substantially rectangular, but in other embodiments the shape may be modified. For example, FIGS. 7A-7D show a modified example of the bra that uses trapezoidal tabs and triangular corner tabs, as well as different positioning of the tabs relative to one another and relative to the respective edge of the cup in order to provide additional flexibility in attaching the straps thereto.

As shown in FIG. 1, the tabs 110 are used for connecting one or more straps 120 to the cups 102, 104, using fasteners 112, such as hooks configured to engage with the tabs 110, provided on the straps 120. Exemplary straps that can be used with the inventive bra 100 are described in more detail below and shown in more detail in FIGS. 5, 9A-9B, and 10-12.

Figure 2:
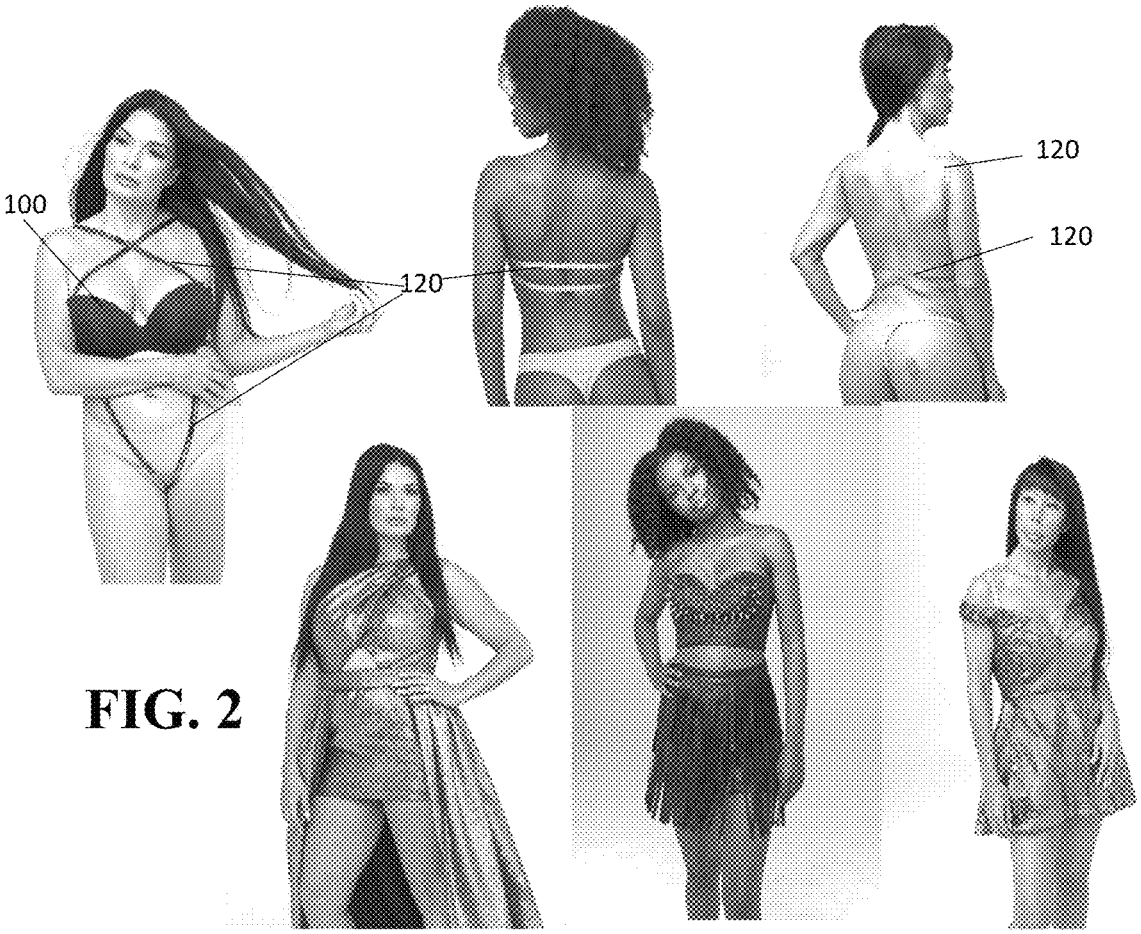
FIG. 2 shows two different illustrative configurations of how the backless bra of FIG. 1 may be worn.

When worn, the backless bra 100, using the inventive straps 120 as described herein, can be worn in different configurations to enable the wearer to use the same bra in different manners. FIG. 2 shows photographs of two different configurations, for illustrative purposes, of how the backless bra may be worn.

As shown in FIG. 2, the straps 120 may be coupled to the bra 100 in different manners and at different locations to enable the same bra 100 and straps 120 to be worn by the wearer to provide two distinctly different functions and looks. In the photographs of FIG. 2, the model on the left is wearing the bra in a crossfront configuration which is described in more detail below with respect to FIGS. 20A-20C, so that the bra can be worn with backless garments that have two panels crossing over one another in the front. In the photographs of FIG. 2, the model in the middle is wearing the bra and straps 120 in a strapless configuration which is described in more detail below with respect to FIGS. 17A-17D so that the bra can be worn with strapless garments. Finally, the model on the right is wearing the bra in a configuration described in more detail with respect to FIG. 21D below, in which the bra is worn with a strap extending around the model's torso and two arm straps extending around the model's shoulders.

Figure 3:
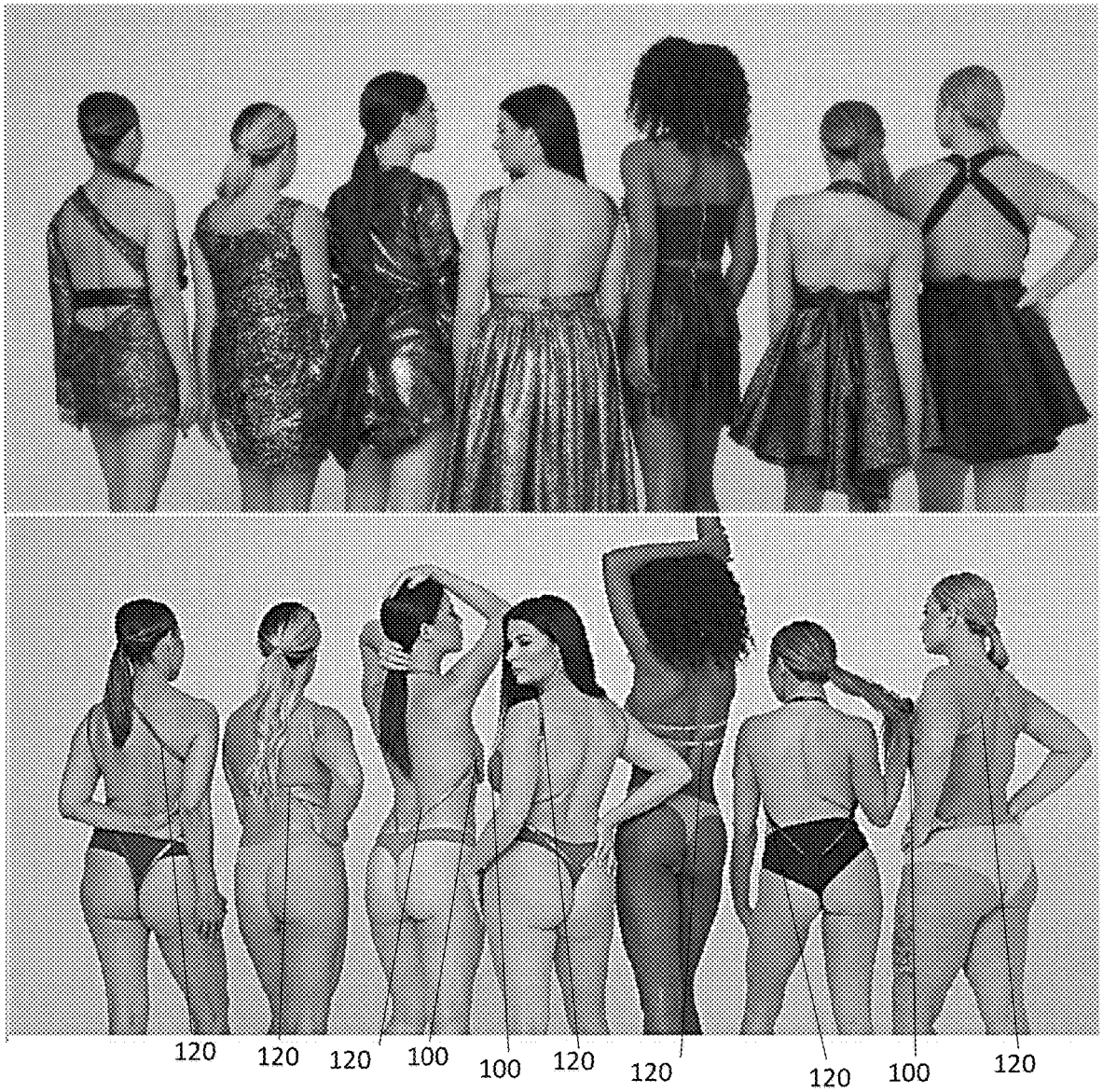
FIG. 3 shows photographs of models wearing the backless bra of FIG. 1 in different configurations.

The backless bra may be worn in other configurations, such as shown in the exemplary photographs presented in FIG. 3. Viewing from left to right, FIG. 3 shows an asymmetrical configuration which is described in more details with reference to FIGS. 17A-17D, a configuration which is described in more detail with reference to FIGS. 21A-21D (also shown in FIG. 2), an "original" backless configuration which is described in more detail below with reference to FIGS. 14A-14D, a crossfront configuration which is described in more detail below with reference to FIGS. 20A-20C (also shown in FIG. 2), the strapless configuration which is described in more detail with reference to FIGS. 18A-18D (also shown in FIG. 2), a halter configuration which is described in more detail with reference to FIGS. 15A-15D and a cross-back configuration which is described in more detail below with reference to FIGS. 16A-16D.

As illustrated, FIGS. 2 and 3 are exemplary photographs of models with different body shapes wearing the backless bra of the present invention in different manners/configurations. For ease of understanding at least some of the benefits of the present invention, photographs are presented that show the model wearing the backless bra (in different configurations) both with and without a dress/attire. As one benefit, dresses and other garments that have distinctly different designs and that cover portions of the body in different ways can be worn with the same backless bra of the present invention, without sacrificing the function and aesthetics of those distinctly different dresses.

The backless bra may be employed in further configurations and the configurations shown in FIGS. 2 and 3, along with other configurations, are further discussed in the section that follows the below description of the backless bra's structure.

Illustrative Structure of Backless Bra of the Present Invention

Figure 4:
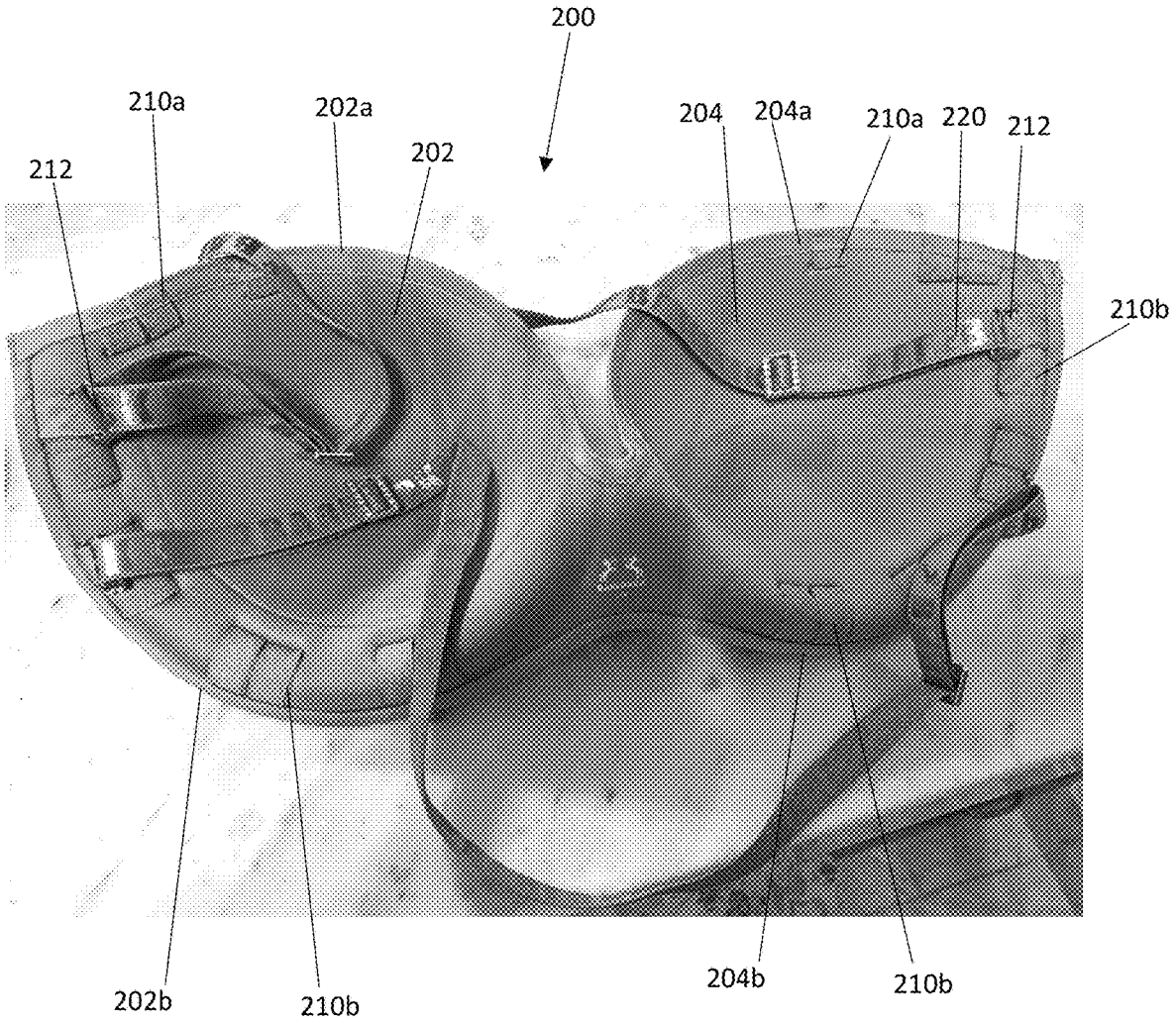
FIG. 4 shows another example of an inner surface structure of the backless bra of the present invention.

FIG. 1 described above shows one exemplary backless bra 100 of the present invention. FIG. 4 is a photograph of another exemplary backless bra 200, showing the inner surface of the bra, in accordance with the present invention. Similar to the backless bra of FIG. 1, the bra of FIG. 4 includes first and second cups 202, 204, each of which has a plurality of tabs 210*a* provided along an upper edge thereof 202*a*, 204*a* and a plurality of tabs 210*b* provided along a lower edge thereof 202*b*, 204*b*. The tabs 210*a*, 210*b* are formed as rigid loops, which are attached to the cups by sewing or other suitable techniques. The tabs 210*a*, 210*b* are used for detachably connecting one or more straps 220 to the first and second cups 202, 204 so as to enable a wearer to wear the bra 200 in a variety of configurations, such as those shown in FIGS. 2 and 3. In FIG. 4, two straps 220 are shown as being connected to selected tabs 210*b* provided on the first and second cups 202, 204 using hook fasteners 212 so as to provide a strapless wearing configuration, wherein the straps 220 extend around the wearer's torso. As described above with respect to FIGS. 1-3, other straps may be used with the bra 200 to connect with the tabs 210*a*, 210*b* on the cups in order to wear the bra in a variety of configurations. The configurations and uses of the bra 200 with the tabs 210*a*, 210*b* in FIG. 4 are similar or substantially the same to those of the bra 100 with the tabs 110*a*, 110*b* of FIG. 1, and therefore, detailed descriptions thereof, are omitted for purposes of clarity and conciseness.

As discussed above, in the above-described representative backless bras of the present invention, the underside of the bra includes a set of tabs 110, 210 to which the various straps 120, 220 of the backless bra can be attached. As shown, the backless bra includes 22 tabs (11 within each cup) to allow the wearer to use the backless bra in a fairly large number of varieties of wearing configurations.

The placement and number of tabs may be different than that shown in the figures and/or described herein. In addition, the shape of the individual tabs and their positioning or inclination relative to the upper or lower edges of the cup and relative to one another may be modified from those shown in order to facilitate attachment of straps in the variable wearing configurations as well as to allow better pivoting of the straps relative to the tabs. Also, as further discussed below, the particular shape, material, construction and/or design of the bra portion, including its cups, may be different than that shown in the figures presented herein. In the exemplary embodiments of FIGS. 1 and 4, the cups are molded cups with an underwire embedded adjacent to the lower edge of each cup for providing support. In other embodiments, the cups may be formed without any padding and/or without embedded underwire.

Figure 5:
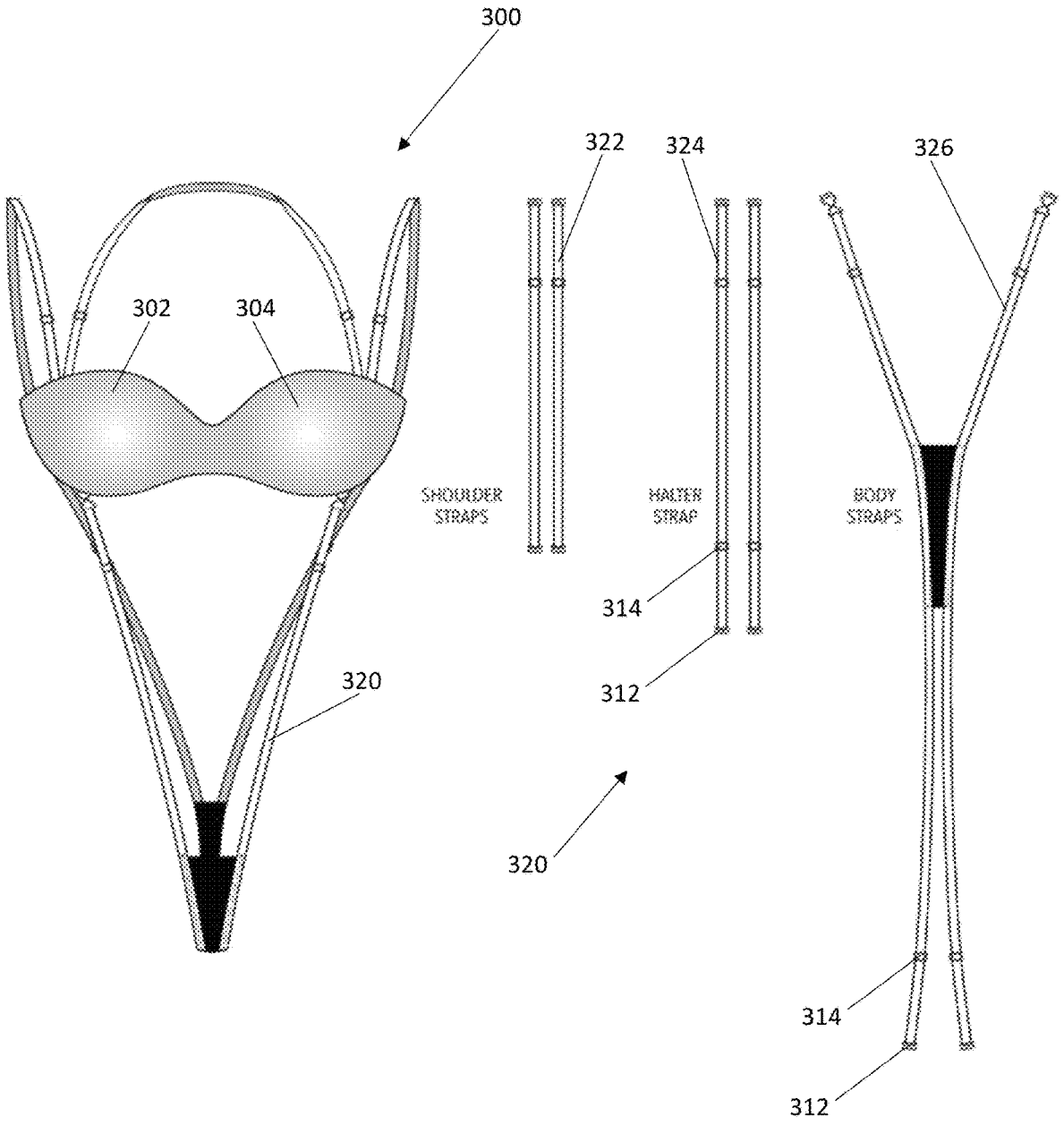
FIG. 5 shows a basic structure of the various components of the backless bra and accompanying straps.

FIG. 5 shows the basic structure of the various components of the backless bra 300 (inclusive of the straps 320) of the present invention. As shown in FIG. 5, the backless bra 300 of the present invention includes, along with the bra cups 302, 304, a set of shoulder straps 322, one or more halter straps 324, and a set of interconnected body straps 326 with a gusset/panty liner. In FIG. 5, the bra 300 is illustrated with all of the straps 320 connected to the tabs (not shown) on the bra cups 302, 304 and additionally, each of the straps 322, 324, 326 is shown separated from the bra cups 302, 304. In some embodiments, the body straps 326 may be separated from one another, without using a gusset/panty liner, while in other embodiments, additional separated body straps may be provided for additional customization of the bra 300. Since some of the configurations employ two halter straps 324 (also called multi-functional straps), two halter straps 324 are provided with the bra.

The straps 320 may be formed from suitable materials with sufficient elasticity and strength, including fabric or woven materials, polymer materials, etc. In some embodiments, the straps and the bra cups may have the same color as the bra cups, while in other embodiments, the straps may be transparent or translucent or may have a different color. For example, the straps may have a color that is similar to a color of a wearer's skin or may be selectable from one or more colors to match to a wearer's skin as closely as possible. As shown in FIG. 5, the straps 322, 324, 326 have adjustable lengths in order to allow a wearer to customize the fit of the bra.

The backless bra also includes hardware, such as fasteners 312 for connecting the straps to the bra and sliders 314 for adjusting the lengths of the straps, described in further detail below. The hardware may be decorative and may have decorative shapes, use decorative materials, such as plastic or metallic fasteners and sliders having a gunmetal, gold, silver, rose gold, etc. finish, and/or may include other decorative elements, such as crystals, rhinestones, jewels and other embellishments.

As discussed further below in connection with the various configurations of the present invention, different straps are not utilized in various configurations, the number of straps used also are different in the different configurations, and the connection of the straps to the bra also may be at different locations along the bra depending on the desired configuration, among other factors including the size and shape of the wearer (to be discussed).

Figure 6A:
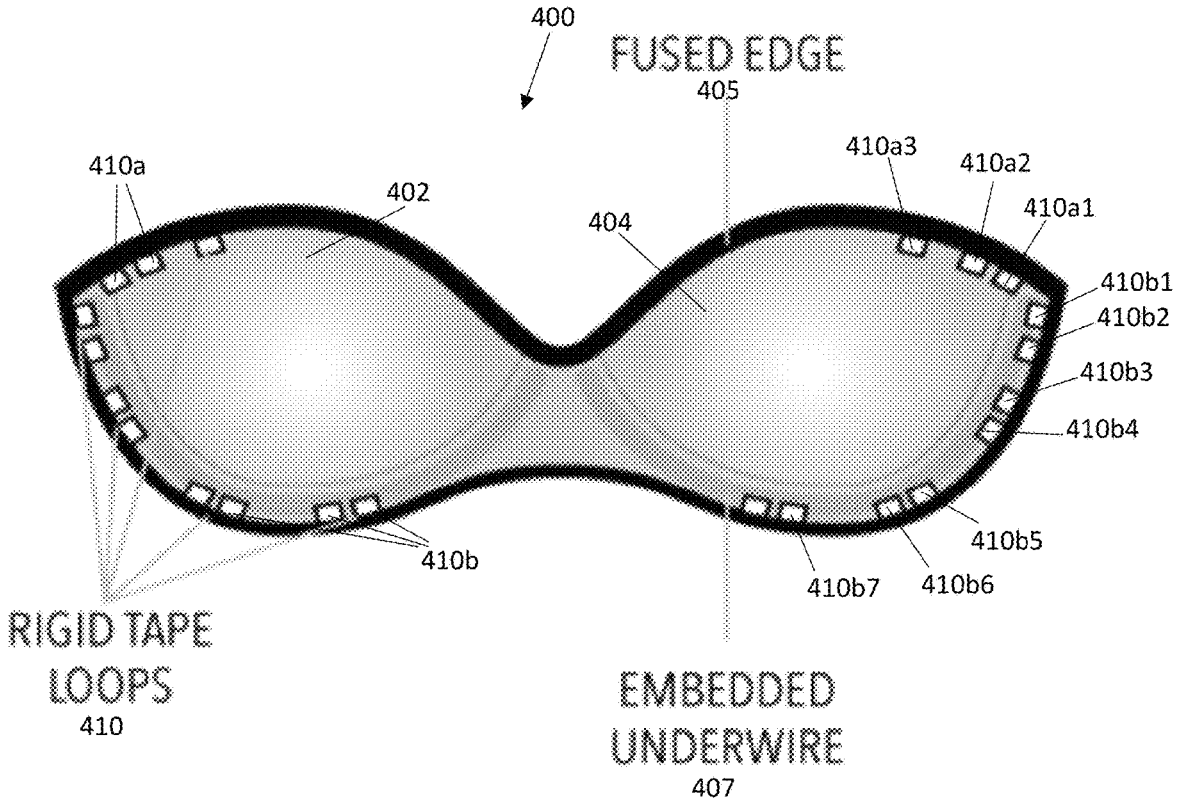
FIG. 6A schematically shows the structure of an exemplary internal surface of the bra in accordance with the present invention.

FIG. 6A schematically shows the structure of an exemplary internal surface of the bra 400 in accordance with the present invention. As shown in FIG. 6A, the bra 400 includes first and second bra cups 402, 404 with a set of rigid tape loops that create 22 tabs 410 for connection to the straps (not shown). Each of the bra cups 402, 404 has a plurality of tabs 410*a* formed along an upper edge of the cup 402, 404, and a plurality of tabs 410*b* formed along a lower edge of the cup 402, 404.

The bra 400 in FIG. 6A also includes a fused edge 405 to provide a smooth or invisible appearance when worn and an embedded underwire 407, which is embedded in an underwire channel. However, different bras may be employed by the present invention. For instance, the backless bra of the invention need not include embedded underwire and/or a fused edge. Further, other structures may be employed in place of the rigid tape loops to create tabs for connection to the straps.

As shown in FIG. 6A, the upper tabs 410*a* extend from or adjacent to the fused upper edge of each cup and preferably, each tab has one end attached at or near the fused edge and another end attached at a predetermined distance from the fused edge in order to form a loop. This creates a smooth construction that also eliminates or limits movement of the tabs relative to the cup. However, in some embodiments, both ends of the tab may be attached in the same position so as to form a loop extending from the attachment position. The upper tabs 410*a* may be attached to the cup by any suitable method, including sewing, adhesion, etc. In some embodiments, one or both ends of the upper tabs may be sewn or adhered to a seam in a respective bra cup or inserted into or incorporated into a seam in a respective bra cup for attachment. Although the upper tabs 410*a* in FIG. 6A are shown as extending at or near the fused edge, the specific attachment location may be modified, depending on the configuration of the cup, to be closer to the fused edge or further away from the fused edge.

In FIG. 6A, three upper tabs 410*a* are included on a neckline of each cup, including a pair of closely spaced first and second upper tabs 410*a*1, 410*a*2 positioned closer to the outer side end of the cup and a single third upper tab 410*a*3 positioned further away from the outer side end of the cup and also positioned at a larger distance interval from the adjacent second upper tab 410*a*2. In one illustrative example of a 34B size bra, the first upper tab 410*a*1 is positioned about 12.7 mm from an outer most side edge of the bra cup, the second upper tab 410*a*2 is positioned about 5 mm from the first upper tab 410*a*1, and the third upper tab 410*a*3 is positioned about 19.1 mm from the second upper tab 410*a*2. It is understood that these distances are exemplary and may vary, particularly depending on the cup size and the bra style. Moreover, where additional or other wearing configurations or additional customization is desired, the number of tabs and their positioning along the upper edge of the cups may be varied.

As also shown in FIG. 6A, the lower tabs 410*b* extend from an underwire channel cover and across, or partially across the underwire channel cover. Similar to the upper tabs 410*a*, it is preferred that each tab has one end attached at or near the lower edge of the cup and another end attached at a predetermined distance from the edge in order to form a loop so as to create a smooth construction of the bra surface. In some embodiments, one end of each lower tab 410*b* is attached at or near the lower edge of the cup, below the underwire and another end of each lower tab 410*b* is attached at or near an opposing edge of the underwire channel so that each of the lower tabs 410*b* extends across the underwire channel from one side to another side thereof. However, in some embodiments, both ends of the tab 410*b* may be attached in the same position so as to form a loop extending from or projecting from the attachment position. The lower tabs 410*b* may be attached to the cup by any suitable method, including sewing, adhesion, etc. In certain embodiments, one or both ends of the lower tabs may be sewn or adhered to a seam in a respective bra cup or inserted into or incorporated into a seam in a respective bra cup for attachment. In some embodiments, each lower tab may be formed as a circular loop that passes through the bra cup, e.g., through two openings in the underwire channel, and internally passes around the underwire so as to hold the tab in place. In addition, the specific attachment location of the tabs relative to the lower edge may be modified, depending on the configuration of the cup, to be closer to the lower edge or further away from the lower edge.

In the embodiment of FIG. 6A, each cup includes four pairs of closely spaced lower tabs 410*b*, and the distance between adjacent pairs of closely spaced lower tabs 410*b* is greater than between the individual tabs in each pair. Moreover, as can be seen from FIG. 6A, in this illustrative embodiment, the distance between adjacent pairs of lower tabs increases from an outer side edge of the cup in a direction toward the bridge between two bra cups. In one illustrative example of a 34B size bra, the distance between individual tabs in each pair of lower tabs is 5 mm, the distance between a first lower tab 410*b*1 and an outer side edge of the cup is 12.7 mm, the distance between second and third lower tabs 410*b*2, 410*b*3 is 12.7 mm, the distance between fourth and fifth lower tabs 410*b*4, 410*b*5 is 25.4 mm and the distance between sixth and seventh lower tabs 410*b*6, 410*b*7 is 25.4 mm. It is understood that these distances are exemplary and may vary, particularly depending on the cup size and the bra style. Moreover, where additional or other wearing configurations or additional customization is desired, the number of tabs and their positioning along the lower edge of the cups may be varied.

Figure 6B:
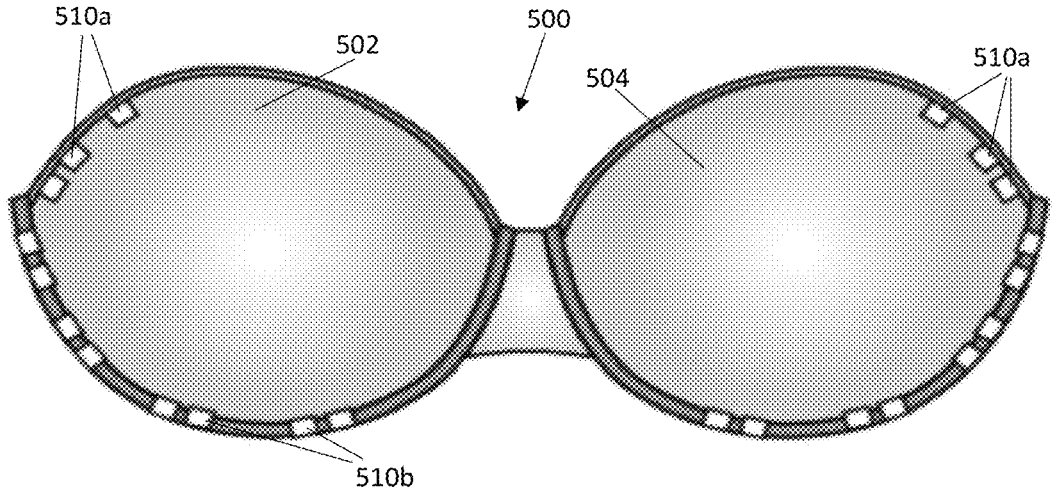
FIG. 6B schematically shows another construction of the bra that includes a set of tabs in accordance with the present invention.

FIG. 6B shows a different construction of the bra 500 that includes a set of tabs 510 on the underside of first and second bra cups 502, 504 in accordance with the present invention. In FIG. 6B, the upper edge may be a fused edge or finished with stitching, such as zig-zag stitching and the lower edge includes an embedded underwire within an underwire channel. The bra cups in FIG. 6B have a different shape and configuration. However, the configuration and arrangement of the tabs 510 in the bra of FIG. 6B is similar or substantially the same as in FIG. 6A, and therefore, detailed description thereof is omitted.

The structures shown in FIGS. 6A and 6B are exemplary, and other structures in accordance with the present invention may be employed. Moreover, the number and locations of the tabs within the bra may be different than that shown. For example, if a bra configuration includes an underband below the underwire channel, the lower tabs 410*b*, 510*b* may extend across or partially across the underband in some embodiments. In another example, if the upper portion of each cup includes a lace or other type of embellishment extending to the upper edge of the cup, the upper tabs 410*a*, 510*a* may be provided further away from the upper edge of the cup so as not to interfere with the embellishment on the bra cup.

As mentioned above, the particular shape, material(s), construction and/or design of the bra may be different than that shown in the various figures herein. For example, the cups of the bra can be modified to provide any of the following styles: plunge, full-cup, demi-cup, push-up, balconette, and shelf, and other styles known in the art. The cups can be made from a variety of materials, and have different sizes and colors, as would be understood in the art.

As shown in FIGS. 1-6B, the bra can be worn as a backless bra without encumbering the view of a wearer's back when worn. To facilitate this, the bras shown in FIGS. 1-6B include the bra cups but do not have any side panels or wings attached to the bra cups or extending from the bra cups and also do not include a backband attached to the bra cups. In the embodiments of FIGS. 1-6B, the bra also does not include an underband under the bra cups, but in other embodiments, an underband may be provided and the underband may extend only under the bra cups and would not extend into a backband. These configurations create a backless bra, which can be worn with backless garments without being visible and would not obstruct the view of a wearer's back. It is also understood that the bra may be modified so as not to be a "backless bra" and to include wings and/or a backband. In such embodiments, the backband would obstruct the view of the wearer's back. However, use of tabs on the bra cups of such bras would allow such a bra to be customized for wearing with a variety of other garments and/or to have other garment elements attach to the bra, e.g., shaping elements.

Moreover, as mentioned above, the configuration, and in particular, the shape of the tabs and orientation of the tabs relative to the cup's upper or lower edge may be modified from those shown in FIGS. 1, 4 and 6A-6B. For example, in some embodiments, the tabs may have a triangular or trapezoidal shape instead of a substantially rectangular or square shape. Moreover, in other embodiments, the tabs may be inclined relative to the upper and/or lower edge of the cup and the inclination angles may be varied among the tabs depending on their location along the upper and/or lower edge.

FIGS. 7A-7D show another embodiment of the bra 600 which includes a plurality of tabs 610, 611 having different configurations. The backless bra 600 of FIGS. 7A-7D includes first and second bra cups 602, 604, which may be molded and include an underwire or may have any other suitable construction, similar to the bra cups shown in FIGS. 1, 4 and 6A-6B and described above. Each of the bra cups 602, 604 includes one or more first tabs 610, which have a substantially trapezoidal configuration, and a corner tab 611 formed at the outer side corner of the cup having a substantially triangular configuration.

Figures 7A, 7B, 7C, 7D:
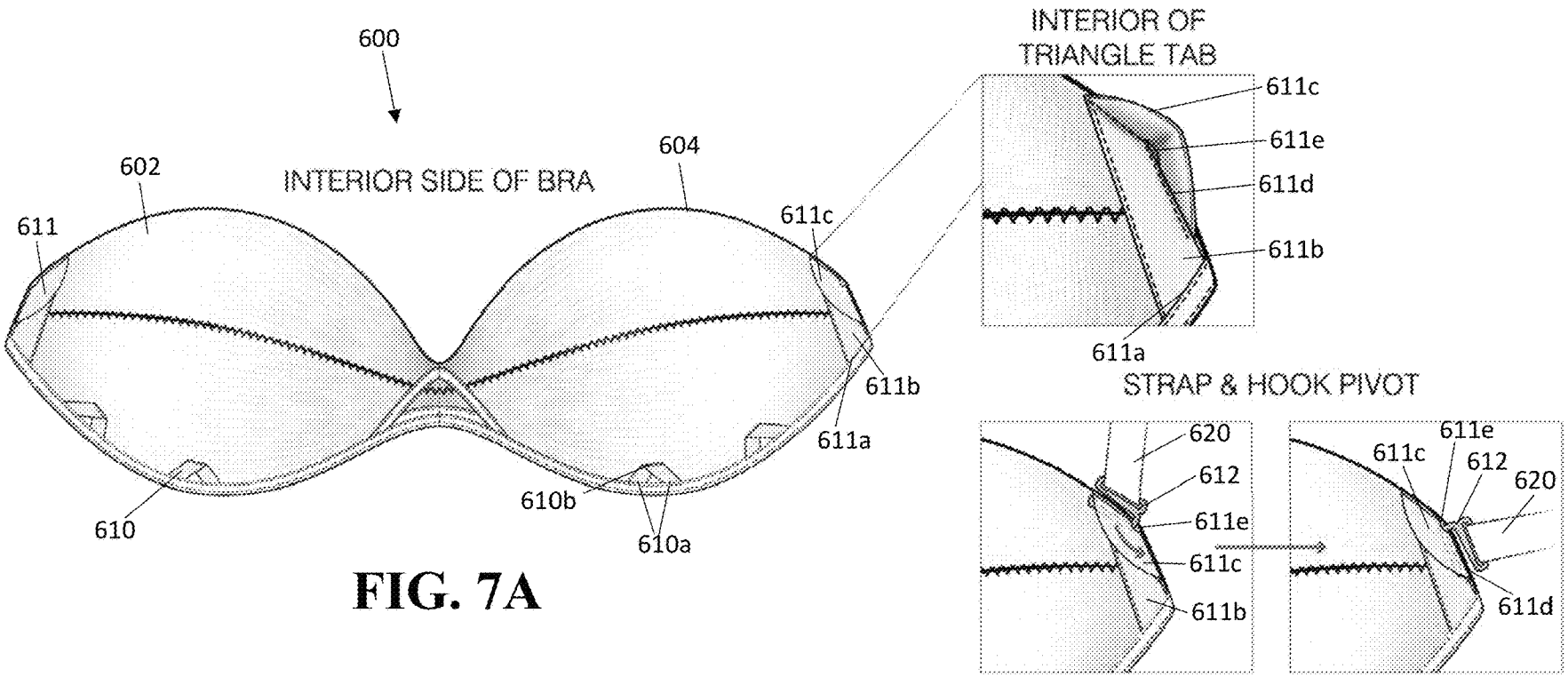
FIGS. 7A-7D schematically shows a modified construction of the backless bra that includes modified configurations of the tabs.

As shown in FIG. 7A, each bra cup 602, 604 has two first tabs 610 provided on its underside along a lower edge of the cup. Although not shown in the illustrative embodiment of FIG. 7A, each cup may also include one or more first tabs 610 along an upper edge of the cup. Moreover, the number of first tabs 610 along the lower and upper edges of each cup may be varied, depending on the intended wearing configurations of the bra. In some embodiments, each first tab 610 is formed from a single strap or ribbon having both ends 610*a* thereof attached adjacent to the respective edge of the bra cup 602, 604 and spaced apart by a first predetermined distance along the edge of the bra cup and having a central area 610*b* of the strap or ribbon attached to the bra cup 602, 604 at a second predetermined distance away from the edge of the bra cup. In some embodiments in which the bra includes underwires, the second predetermined distance may be the same or similar to the width of an underwire channel in the bra cup, so that each first tab 610 extends across the underwire channel. In certain embodiments, the second predetermined distance is dictated by the total length of the strap or ribbon and by the first predetermined distance between the ends 610*a* of the strap or ribbon. In any case, the length of the strap or ribbon, and the first and second predetermined distances are selected so that attachment and detachment of hook fasteners or other fasteners to the first tab 610 is made easy for a wearer, while also preventing accidental detachment of the straps from the first tab 610.

As shown in FIG. 7A, the strap or ribbon of the first tab 610 in the central area 610*b* is folded over itself at an angle so as to create a flat and smooth construction. Although in the present illustrative embodiment, each first tab 610 is formed from a single strap or ribbon, it is also contemplated that each first tab 610 may be formed from two separate straps or ribbons, each of which has one end thereof attached adjacent the respective edge of the bra cup 602, 604 and opposing ends overlapping with one another and attached to one another and to the bra cup 602, 604 at a second predetermined distance away from the edge. The attachment of the straps or ribbons forming the first tabs 610 may be accomplished by sewing, by using adhesives, and any other suitable means.

With the above-described configurations, each first tab 610 forms two loops angled relative to one another and relative to the respective edge of the bra cup, which can be used for connecting the straps to the bra cups via hooks or other suitable fasteners. Since the loops of each tab are angled, it is possible to improve customization of the different wearing configurations by making it easier to appropriately orient the strap and to allow for pivoting of straps, as needed, relative to the bra cups to which they are attached. In the illustrative embodiment of FIG. 7A, each loop is angled at about 45 degrees or about 135 degrees relative to the edge of the bra cup. In other embodiments, other angles greater than 0 degrees and smaller than 180 degrees, and preferably in the range of 20-160 degrees, and more preferably in the range of 30-150 degrees, may be used in order to provide different orientations and pivoting abilities for the straps.

In addition, manufacturing of the bra shown in FIGS. 7A-7D is simplified by requiring three points of stitching or other suitable attachment in order to attach each first tab 610 to the bra cup and to form 2 separate loops, instead of requiring four points of stitching or other attachment in order to create two separate loops in the embodiments of FIGS. 6A and 6B. This configuration also results in materials savings during manufacture.

As shown in FIG. 7A-7D, each corner tab 611 is formed adjacent to an outer side corner of the bra cup 602, 604. The outer side corner of the bra cup may generally be located where the lower edge of the cup intersects the upper edge thereof. In other embodiments, the outer side corner may be formed by the shape of the upper edge just above the intersection with the lower edge of the bra cup, as shown in FIGS. 7A-7D. Each corner tab 611 includes a strap or a ribbon having a first end 611*a* attached adjacent to the lower edge of the cup 602, 604, at or near the outermost side of the bra cup, a first portion 611*b* extending from the first end 611*a* toward the upper edge of the cup 602, 604 in the outer side corner and a second portion 611*c* extending from the first portion 611*c* and folding inwardly over the first portion 611*b* so as to overlap with at least a portion of the first portion 611*b* and to form a loop that allows a strap and hook to pivot when attached thereto.

FIG. 7B shows an enlarged view of the corner tab 611 and its interior construction. As shown in FIG. 7B, the first portion 611*b* of the strap or ribbon is attached to the corner of the bra using any suitable means, such as by stitching each lengthwise side of the first portion 611*b* to the corner of the bra 600. In the illustrative embodiment of FIGS. 7A-7D, the second portion 611*c* of the strap or ribbon folds inwardly to overlap with a top area of the first portion 611*b* and curves toward an outer edge of the corner. A second end 611*d* of the strap or ribbon is attached to the bra cup at outer edge of the corner or adjacent thereto, leaving a small opening 611*e* between the fold of the strap or ribbon and the point of attachment of the second end 611*d* of the strap so as to allow for insertion of a hook fastener. This construction results in a triangular tab formed by the second portion 611*b* of the strap or ribbon.

Although in FIG. 7B, the corner tab 611 includes first and second portions 611*b*, 611*c* of the strap or ribbon forming the triangular tabs, in other embodiments, the first portion 611*b* may be omitted and the second portion 611*c* includes two ends which are attached adjacent to the corner edges of the bra so as to form a similar triangular tab. In any of these embodiments, the second portion 611*c* of the strap is attached to the corner area of the bra cup so that its ends are angled relative to one another at an angle greater than 0 degrees and smaller than 180 degrees, and preferably, at an angle of at least 90 degrees and smaller than 180 degrees. In some exemplary embodiments, the angle between the two ends of the second portion 611 is between 90 and 160 degrees, and preferably between 120 and 150 degrees, although the angle may vary depending on the shape of the bra cups, particularly the shape of the upper edges of the bra cups. In the configurations of these embodiments, each corner tab forms two loops oriented in different directions, e.g., vertical and horizontal.

FIGS. 7C and 7D show a connection between a strap 620 with a hook fastener 612 and the corner tab 611 that allows for pivoting of the hook and strap so that strap placement can go from vertical to horizontal and vice versa. As shown in FIGS. 7C-7D, the hook fastener 612 is inserted into the opening 611*e* between the fold of the strap or ribbon and the attachment of the second end 611*d* of the strap or ribbon at the corner. In FIG. 7C, the hook fastener 612 and strap 620 are positioned in a vertical configuration, wherein the hook fastener is engaged with corner tab at the fold between the first and second portions 611*b*, 611*c* of the strap or ribbon. In FIG. 7D, the hook fastener 612 is pivoted into a horizontal configuration so that the hook fastener 612 is engaged with the corner tab at the second end 611*e* of the strap or ribbon. As can be seen in FIGS. 7C and 7D, this configuration of the corner tab 611 allows the hook fastener 612 and the strap 620 to pivot between vertical and horizontal configurations, without requiring disengagement of the hook fastener from the tab 611.

The backless bra 600 of FIGS. 7A-7D may be used with the same set of straps as the one shown in FIG. 5 so as to create different wearing configurations shown in FIGS. 2-3 and in FIGS. 13-18E described herein below. Similar to the backless bras of FIGS. 1, 4 and 6A-6B, the tabs 610, 611 on the backless bra 600 are used for connecting the straps using hardware, such as hook fasteners, to form different wearing configurations.

Illustrative Structure of the Straps of the Present Invention

FIG. 5 above shows a set of straps 320 that are employed within the backless bra of the present invention. The backless bra in certain embodiments includes all the straps 322, 324, 326 that can be employed (e.g., all elements are sold together). In other embodiments, the backless bra includes fewer straps and yet in other embodiments, the backless bra may be sold without straps and the straps that are employed are then separately purchased or otherwise obtained.

Figure 8:
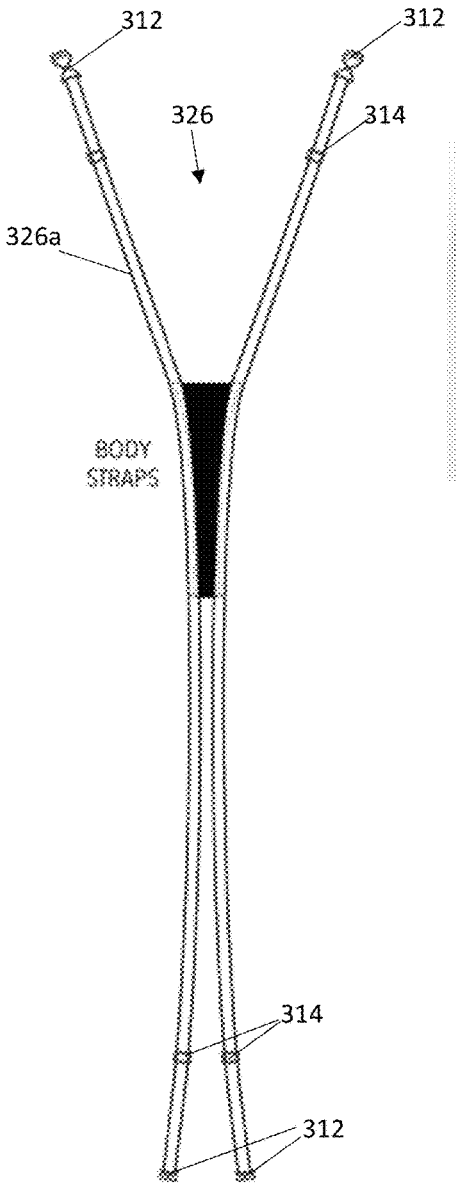
FIG. 8 shows a set of body straps with an integrated gusset/panty liner for use with the backless bras of FIGS. 1-7D.

The present invention includes an inventive set of body straps 326 with an integrated gusset/panty liner, as shown in FIG. 8. The inventive set of body straps 326 with an integrated gusset/panty liner is also called herein, for convenience, as the lower straps or, more simply, the "body strap." The body strap 326 of the present invention includes, as shown in FIG. 8, left and right straps 326*a*, 326*b* and a panty liner 327 that is coupled to and extends between a portion of the left and right straps 326*a*, 326*b*. Similar to how the lower straps in U.S. Patent Application Publication No. 2017/0347720, incorporated herein by reference, are connected to the front main panel of the backless bras disclosed in that incorporated document, each end of both the left and right straps 326*a*, 326*b* of the body strap 326 are connected, during use, to the bra portion of the backless bra of the present invention.

Further, the gusset 327 extending between the left and right straps 326*a*, 326*b* is positioned, when worn, within the crotch area of the wearer and thus serves as a panty liner.

In other versions of the invention, the gusset/panty liner is omitted altogether. In yet further variations of the embodiments described herein, the panty liner extending between the left and right straps includes an integrated thong-style panty or an integrated full-coverage style panty. Other styles/types of panty, underwear or other materials may extend between the left and right straps. Moreover, the panty may be integrated or be a removable element from the straps.

Each of the straps 326*a*, 326*b* includes one or more sliders 314 to allow the wearer to suitably adjust the length of each strap. In some embodiments, the length of each strap 326*a*, 326*b* may be adjusted near each end thereof, while in other embodiments, the length of the straps 326*a*, 326*b* may be adjusted at only one of the ends. Other types of length adjustment mechanisms may be employed.

As also shown in FIG. 8, the ends of the straps 326*a*, 326*b* include fasteners 312, such as hook fasteners provided for connecting the straps 326*a*, 326*b* to the tabs of the bra. The hook fasteners include a closed loop which connects to the strap end and an open loop forming a hook that connects to the tabs of the bra. It is understood that other types of fasteners may be used for connecting with the tabs instead of the hook fasteners.

Figure 9A:
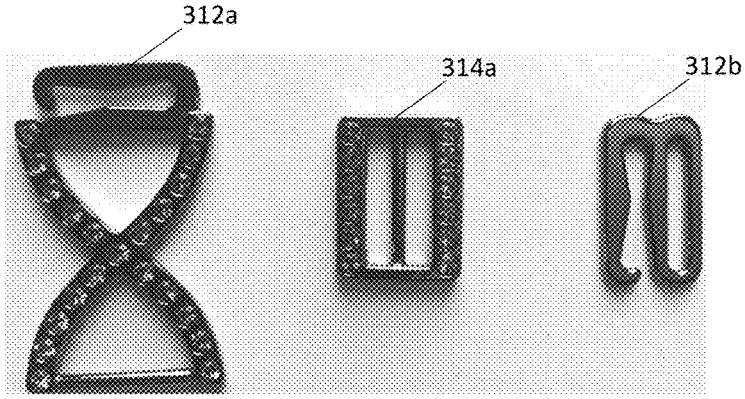
FIGS. 9A-9B shows a set of hardware used for connecting the straps to the tabs of the backless bra of FIGS. 1-7D.
Figure 9B:
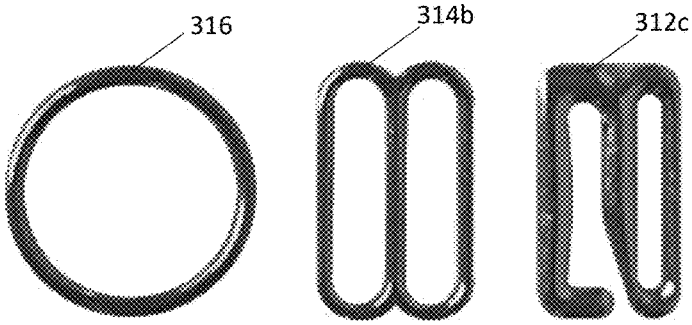

The present invention employs a set of novel hardware to connect the straps to the tabs within the bra and to adjust the lengths of the straps. The hardware is shown in FIGS. 9A and 9B. in FIG. 9A, the hardware includes two types of hooks, including a swan hook 312*a*, which is employed to couple the ends of the straps to the bra and a basic hook 312*b* also used on some of the straps for coupling to the bra. The swan hooks 312*a* include decorative elements, such as crisscrossing arms with crystals thereon to provide embellishment to the straps and the bra. The hardware also includes a slider 314*a* used to change the length of the straps.

In FIG. 9B, another version of a hardware set is shown. The hardware set in FIG. 9B includes a basic hook 312*c*, which has a similar configuration to the basic hook 312*b* of FIG. 9A and is used on the straps for coupling to the bra, and a slider 314*b*, which has a similar construction to the slider 314*a* of FIG. 9A and is used to change the length of the straps. Moreover, the hardware set of FIG. 9B may include a ring 316, which may be a split ring and may be used for connecting the straps to the tabs of the bra.

Figure 10:
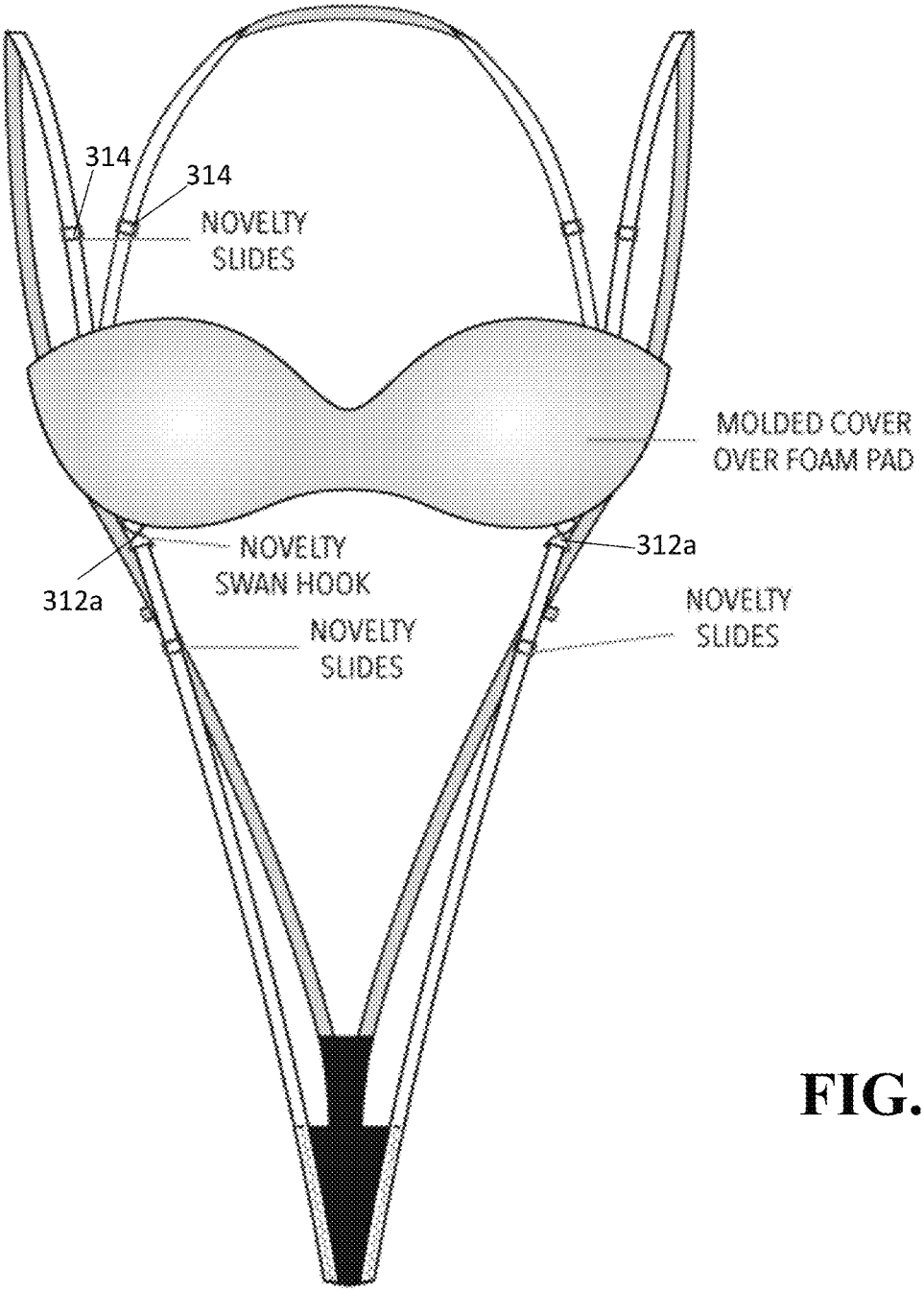
FIGS. 10-11 illustrates exemplary usage of the hardware of FIGS. 9A-9B with the backless bra of the present invention.
Figure 11:
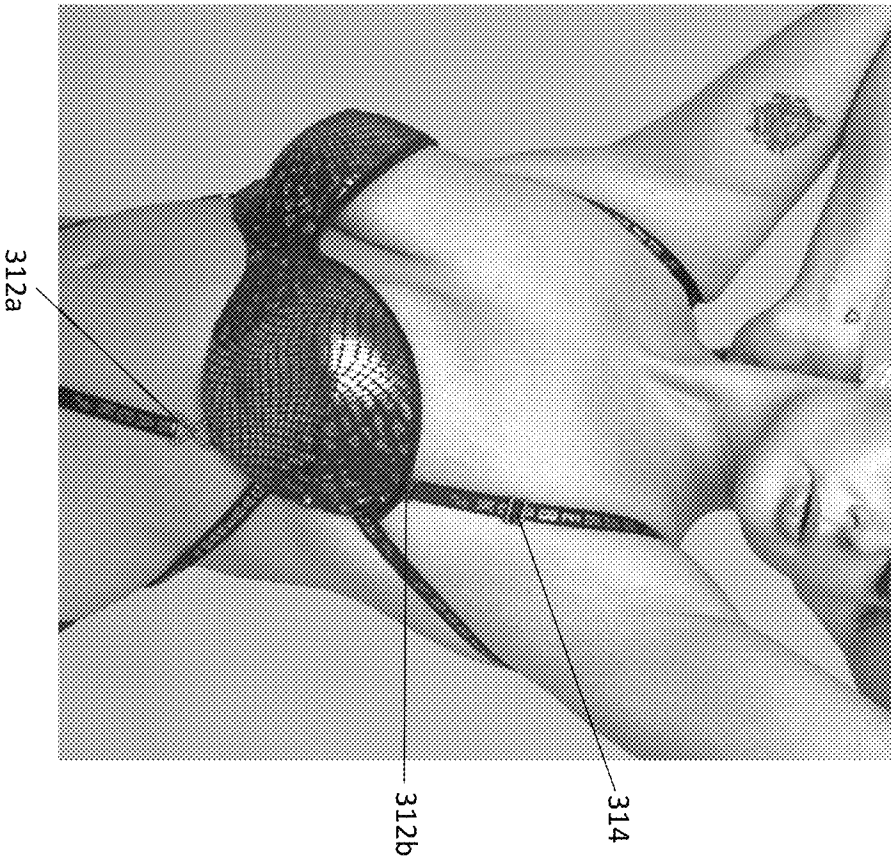

FIGS. 10 and 11 illustrate exemplary usage of the above hardware of FIG. 9A within the backless bra of the present invention. As illustrated in FIG. 10, the swan hooks 312*a* are disposed at the ends of the straps that attach to the front lower portion of the bra. The ornamental novel swan hooks 312*a* are not hidden by the bra. Although not visible in FIG. 10, the basic hooks 312*b* of the hardware in FIG. 9A may disposed at the other ends of the straps that attach to the outer side lower portions of the bra and would be hidden by the bra.

FIG. 11 shows the use of the ornamental novel swan hook, which is visible immediately below the lower edge of the bra. As can also be seen from FIG. 11, the other ends of the straps are attached using other types of fasteners, i.e., non-swan hooks, such as the basic hooks 312*b*, 312*c* shown in FIGS. 9A-9B so that these fasteners are not visible and are hidden from view by the bra.

As shown in FIGS. 10 and 11, the swan hooks 312*a* and slides 314 include a set of decorative stones, such as crystals. The basic hook 312*b*, shown in FIG. 9A and hidden from view in FIGS. 10 and 11, does not need to include decorative elements since it is generally are not visible during use. The novel decorative slides 314 are employed along each of the straps and may also include decorative elements, similar to the swan hooks.

In variations of the present invention, the swan hook 312*a* can be disposed on the ends of any other combination of straps, if desired. In yet another version, only the basic hook 312*b*, 312*c* is used at the end of all the straps. Other types of connectors and/or slides may be employed in place of those shown herein.

Figure 12A:
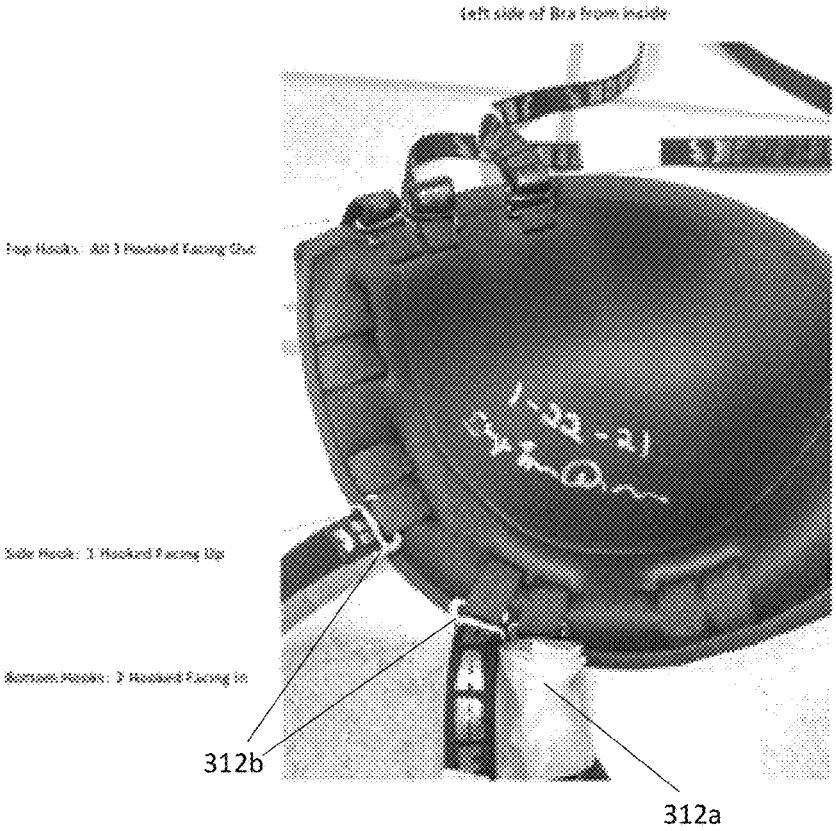
FIGS. 12A-B show how strap ends are coupled to the inner surface of left and right sides of the bra.
Figure 12B:
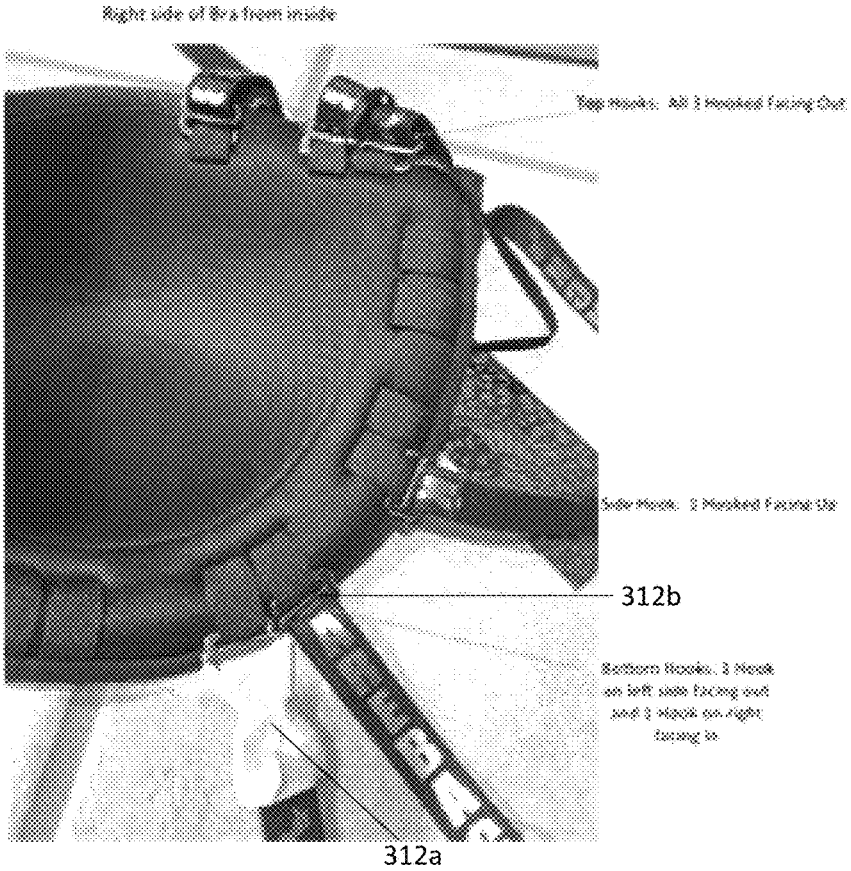

During use of the backless bra, and depending on the desired configuration (discussed further below), the appropriate straps are selected for use based on the desired configuration and the ends of the straps are coupled to the appropriate tabs within the inner surface of the bra. FIGS. 12A and 12B below respectively show how various strap ends are coupled to the inner surface of the left cup 102, 202, 302, 402, 502 and right cup 104, 204, 304, 404, 504 of the bra 100, 200, 300, 400, 500 of FIGS. 1, 4, 5, 6A and 6B. The swan hook 312*a* is covered (with a protective covering) in the photos of FIGS. 12A and 12B. During actual use, the swan hooks would be visible.

Illustrative Configurations of the Backless Bra of the Present Invention

The backless bra of the present invention can be worn in different configurations to advantageously allow it to be worn with a variety of types and styles of dress, gowns and other garments. FIG. 3 illustrates several different configurations of the backless bra 100 of the present invention. As illustrated in the top images in FIG. 3, the backless bra can be worn to provide support while wearing a variety of distinctly different dresses/garments/outfits. Depending on the particular style of dress (or other attire), the present invention is configurable to be worn in a number of configurations described in further detail below.

Figure 13:
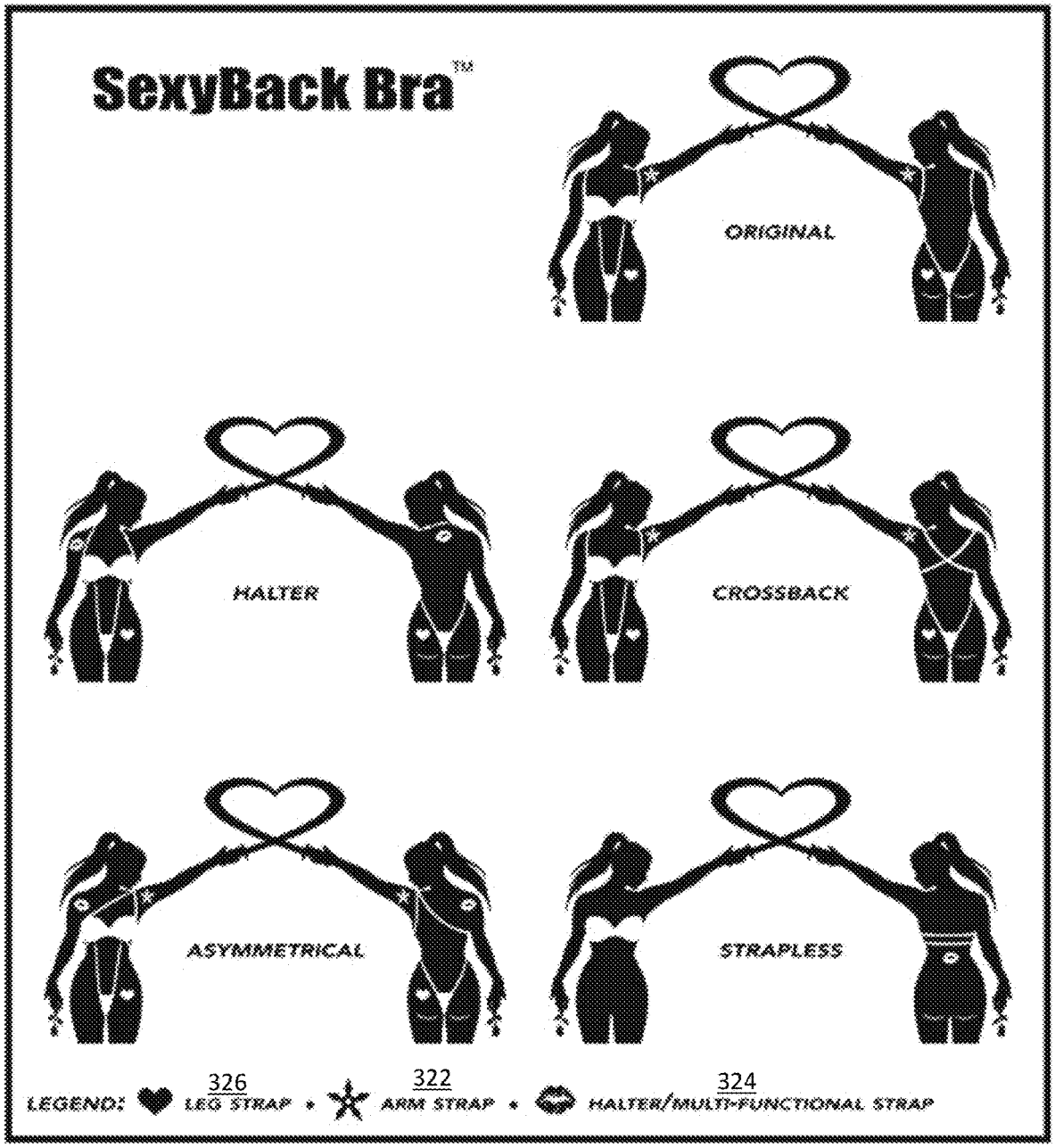
FIG. 13 illustrates five different configurations of the backless bra of the present invention.

FIG. 13 illustrates five (5) different configurations of the backless bra of the present invention, which include: (1) a standard shoulder-strap configuration (also referred herein as the "original" configuration); (2) a halter configuration; (3) a crossback configuration; (4) an asymmetrical configuration; and (5) a strapless configuration. FIG. 13 includes a legend to illustrate which of the three types of straps are employed in each of the various configurations. The leg strap, illustrated with a heart-shaped legend, refers to the herein-described body strap 326 of FIG. 5, which includes left and right straps along with the integrated panty. The arm strap, illustrated with a starfish-shaped legend, refers to the herein-described shoulder straps 322 of FIG. 5. The halter/multi-functional strap, illustrated with a lip-shaped legend, refers to the herein-described halter strap 324 of FIG. 5.

Each of these configurations are described further below.

1. The "Original" Configuration

As illustrated in the schematic diagram shown in FIG. 13, the "Original" configuration employs a leg strap 326 (i.e., body strap) and two shoulder straps 322. The body straps 326 are coupled to the lower portions of the bra and the two shoulder straps are coupled to the upper portions of the bra.

Figure 14A:
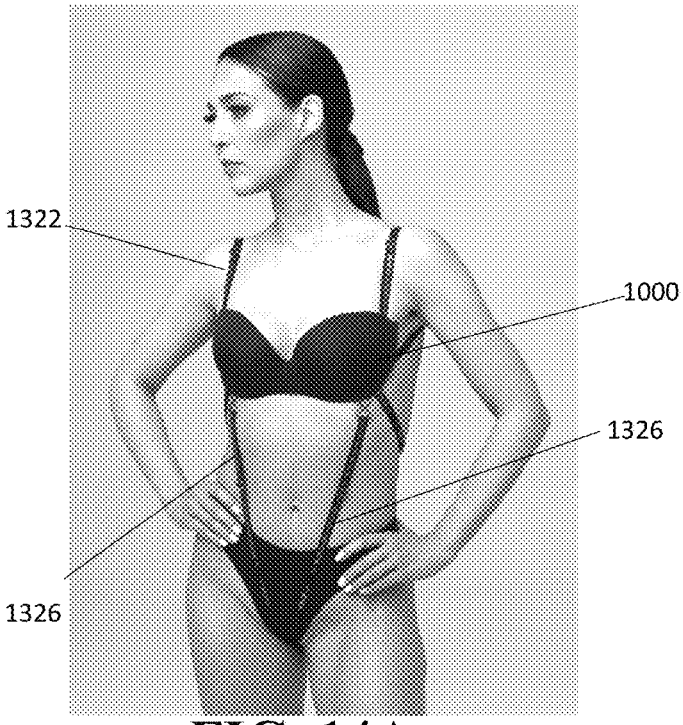
FIGS. 14A-14C show the backless bra being worn in an "Original" configuration of FIG. 13.
Figure 14B:
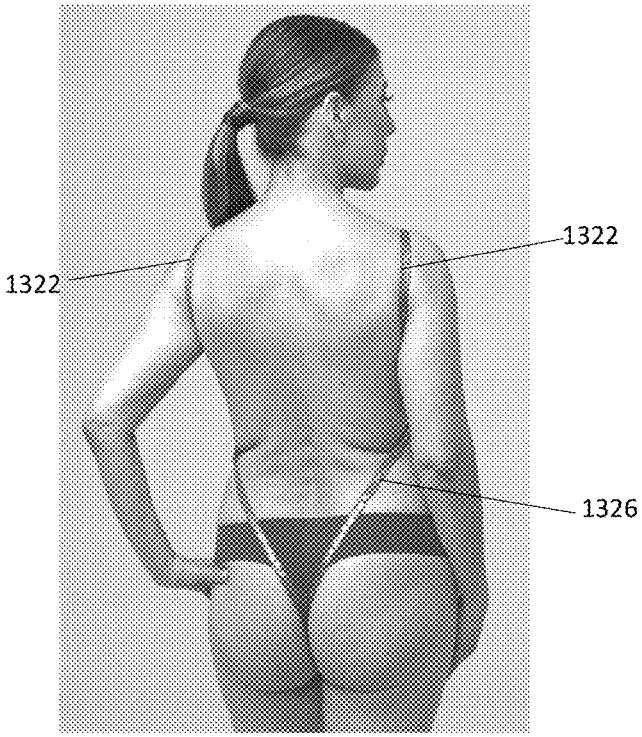
Figure 14C:
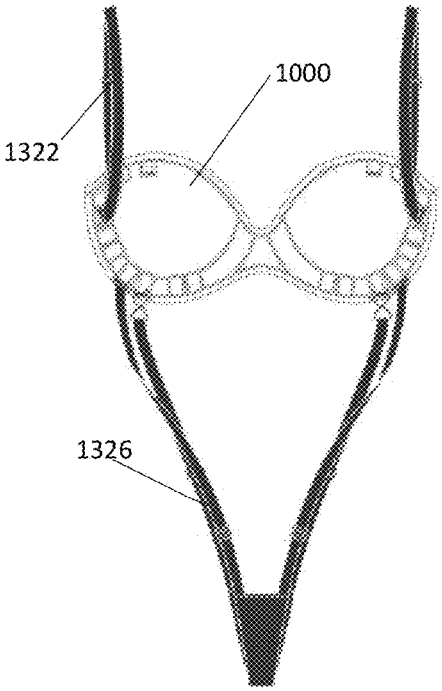

FIGS. 14A-14C shows representative example of the backless bra 1000 worn in the original configuration. The backless bra 1000 may be any of the above-described configurations of the backless bra with the tabs or loops as shown in FIGS. 1, 4, 6A-6B, 7A-D, 12A-12B. As shown, the ends of the leg strap 1326 are attached to the lower portions of the bra 1000 by attaching to the lower tabs provided along the lower edge of the bra cups of the bra 1000. The specific lower tabs to which the ends of the leg strap 1326 are attached may be selected so that the ends of the strap portions extending along the front of a wearer's body are coupled to tabs which are closer to the bridge/center gore between the bra cups, and the opposing ends of the strap portions extending along the back of the wearer's body are coupled to tabs which are further away from the bridge/center gore between the bra cups. In some configurations, where the bras of FIGS. 1, 4, 6A-6B and 12A-12B are used, adjacent tabs on each bra cup may be used for attaching the opposing ends of each strap of the leg strap 1326, while in other configurations, the opposing ends of each strap of the leg strap 1326 may be attached further apart by using non-adjacent tabs. FIG. 14C shows an exemplary attachment of the lower straps 1326 to the bra 1000, but the specific tabs used for attachment may vary. Where the bra of FIGS. 7A-7D is used, opposing ends of each strap of the leg strap 1326 may be attached to the same tab 610 on the respective bra cup, so that each strap end is attached to a different loop of the same tab 610. However, in other variations, the opposing ends of each strap of the leg strap 1326 may be attached to different tabs 610 so as to position the connections further apart from one another.

As also shown in FIGS. 14A-14D, each arm strap 1322 is attached to a respective bra cup by coupling opposing ends of each arm strap 1322 to different tabs on the respective bra cup. As can be seen from FIGS. 14A and 14C, one end of each arm strap 1322 is coupled to one of the upper tabs provided along the upper edges of the bra, while the other, opposing end of the arm strap 1322 is coupled to one of the lower tabs positioned closer to the outer side end of the bra. FIG. 14C shows an exemplary attachment of the upper straps 1322 to the bra 1000, but the specific tabs used for attachment may vary. When used with the bra 600 of FIGS. 7A-7D, the opposing ends of each arm strap may be both coupled to the corner tab 611 of the respective cup. Alternatively, one end of each arm strap may be coupled to an upper tab provided along the upper edge of the respective bra cup and another end may be coupled to the corner tab 611, or one end of each arm strap may be coupled to the corner tab 611 and another, opposing end of the arm strap may be coupled to one of the lower tabs 610 provided along the lower edge of the respective bra cup. The multiple tabs on the inventive bras described above allow for the customization of connections between the bra and the straps so that the fit of the bra may be adjusted to the wearer's body.

As can be seen in FIG. 14B, other than the two shoulder straps 1322, the wearer's back is completely unobstructed by the bra 1000 of the present invention.

2. The Halter Configuration

FIGS. 15A-15D show representative examples of the backless bra 1000 worn in the halter configuration, along with a schematic illustration of this configuration.

Figure 15A:
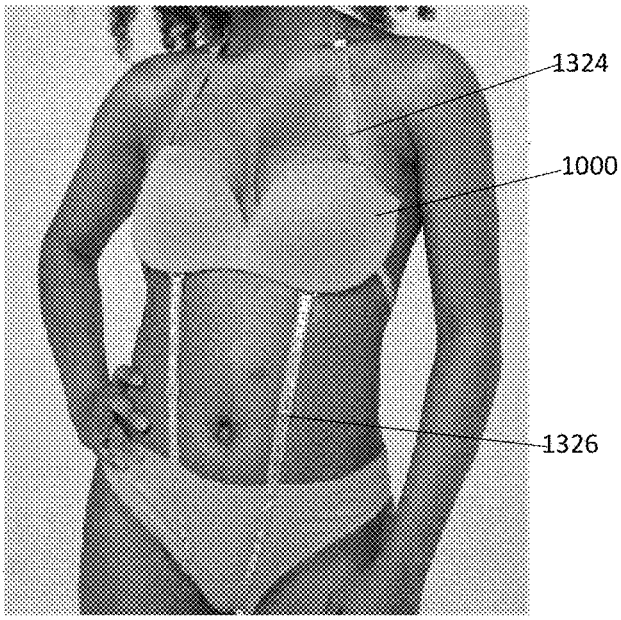
FIGS. 15A-15D show the backless bra being worn in the "Halter" configuration of FIG. 13.
Figure 15B:
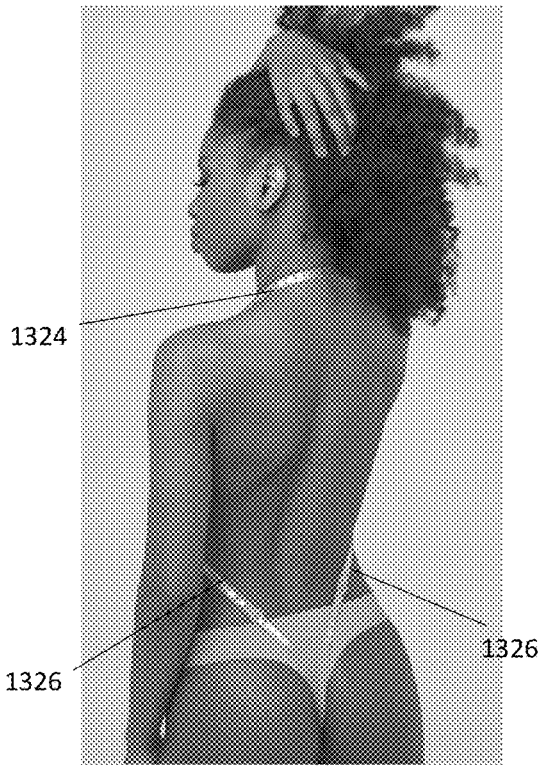
Figure 15D:
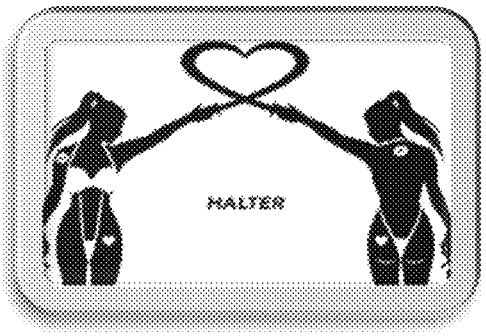
Figure 15C:
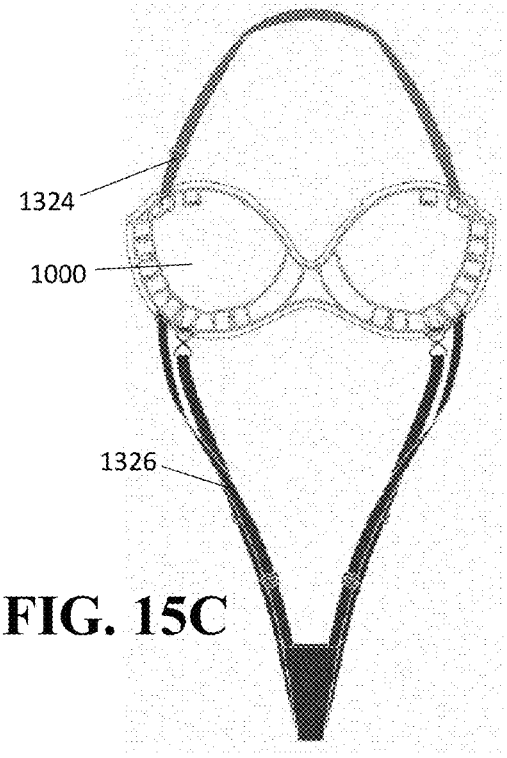

In the Halter configuration, a single halter strap 1324 is employed along with the body strap 1326. Each end of the single halter strap 1324 connects to an upper tab provided along an upper edge of a respective bra cup and the halter strap 1324 extends from one bra cup, around a wearer's neck, to the other bra cup. FIG. 15C shows an exemplary attachment of the upper strap 1324 to the bra 1000, but the specific tabs used for attachment may vary. When used with a bra shown in FIGS. 7A-7D, the ends of the halter strap 1324 may be coupled with the respective corner tabs 611 on the respective bra cups, or may instead be coupled with upper tabs provided along the upper edge of the respective bra cup. The connections between the body strap 1326 and the bra are similar to those of the original configuration of FIGS. 14A-14C, and thus, detailed description thereof is omitted. FIG. 15C shows an exemplary attachment of the lower straps 1326 to the bra 1000, but the specific tabs used for attachment may vary. For example, as shown in FIG. 15A, the lower straps 1326 may be attached so that the front ends of the straps are closer to one another and further away from the back ends of the straps.

Figure 19A:
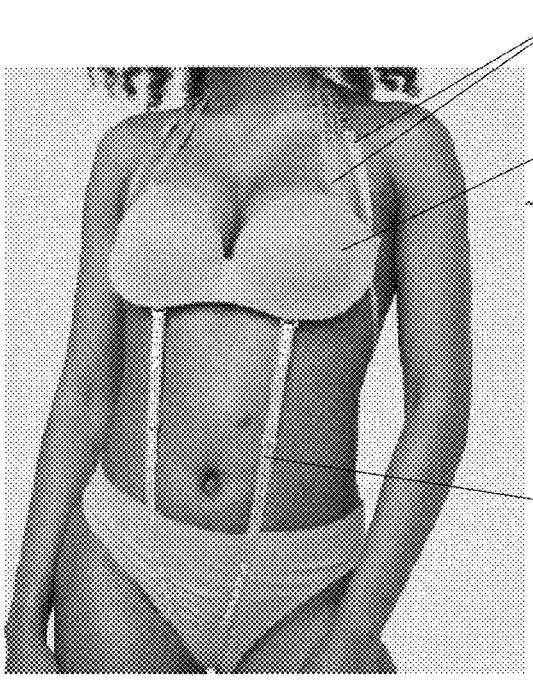
FIGS. 19A-19C show the backless bra being worn in the modified "Halter" configuration.
Figure 19B:
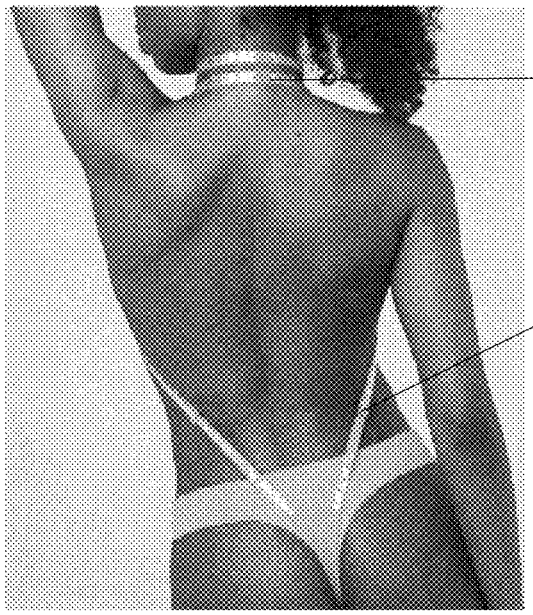
Figure 19C:
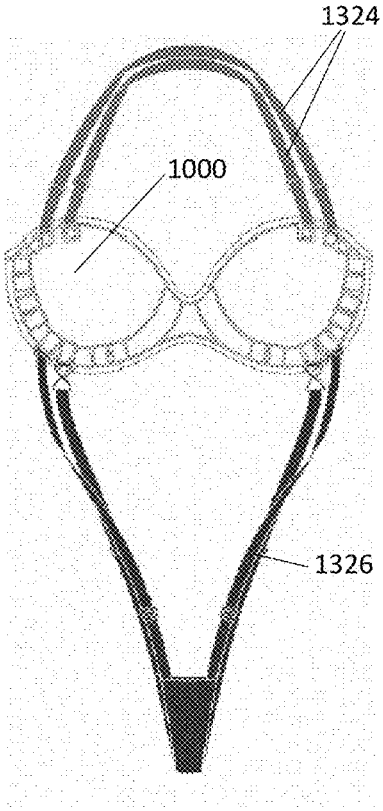

In a variation of this halter configuration, two halter straps 1324 are simultaneously employed. This variation is shown in FIGS. 19A-19C. As shown, this configuration is similar to the one shown in FIGS. 15A-15D, but a second halter strap 1324 is added and attached to different upper tabs on the bra 1000. FIG. 19C shows an exemplary attachment of the upper straps 1324 and the lower straps 1326 to the bra 1000, but the specific tabs used for attachment may vary. Such variation provides the wearer with additional breast support due to the existence of a double set of straps above the bra. Moreover, the use of two halter straps provides a different aesthetic appearance. In such case, while connecting the halter straps to the appropriate tabs in the inner surface of the bra, the appearance of the two halter straps will differ depending on the particular tabs that are employed. Hence, the present invention provides for a set of different sub-configurations with the halter configuration.

3. The Crossback Configuration

FIGS. 16A-16D show representative examples of the backless bra 1000 worn in the crossback configuration, along with a schematic illustration of this configuration.

Figure 16A:
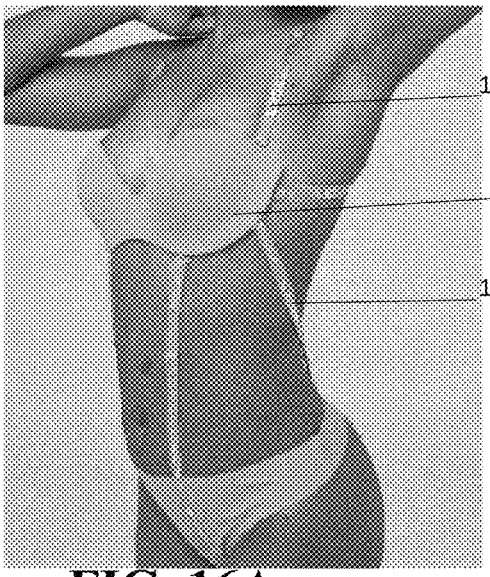
FIGS. 16A-16D show the backless bra being worn in the "Crossback" configuration of FIG. 13.
Figure 16B:
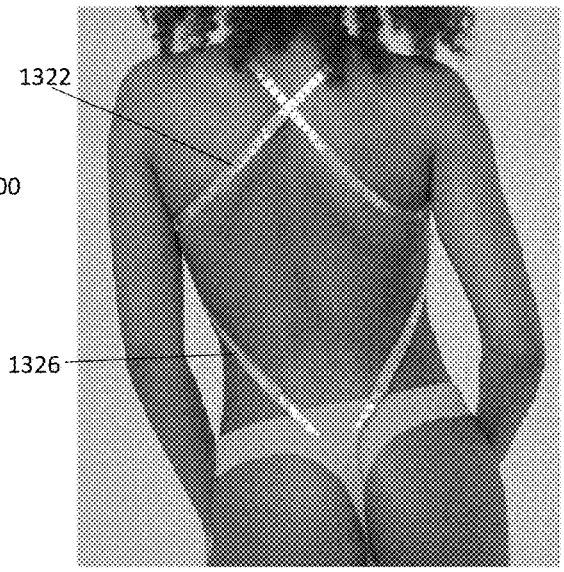
Figure 16D:
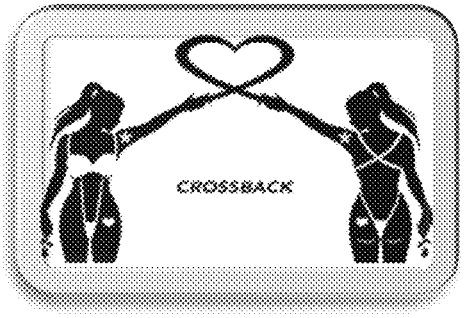
Figure 16C:
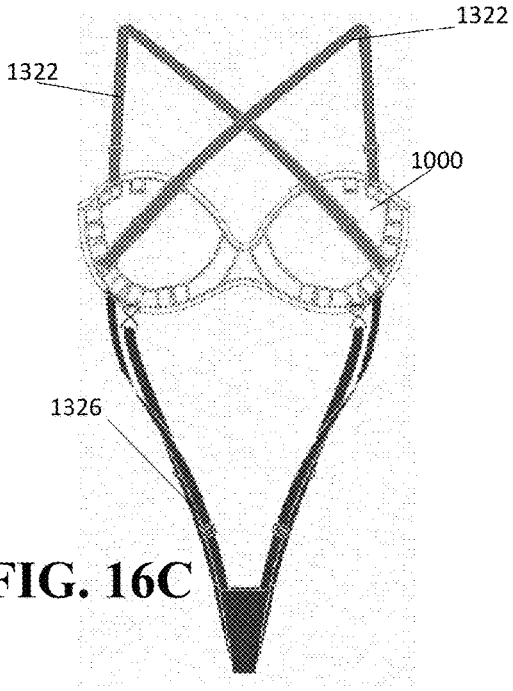

In the crossback configuration, two shoulder straps 1322 are employed along with the body strap 1326. Each shoulder strap 1322 has one end that connects to an upper tab provided along an upper edge of a respective bra cup and a second end that connects to a lower tab provided along a lower edge of the other bra cup after extending across a wearer's back. FIG. 16C shows an exemplary attachment of the upper straps 1322 to the bra 1000, but the specific tabs used for attachment may vary. When used with the bra shown in FIGS. 7A-D, one end of each shoulder strap 1322 may be coupled with a respective corner tab 611 on the respective bra cup and the second end of the shoulder strap 1322 may be coupled with the other corner tab on the other bra cup, or may instead be coupled with one of the lower first tabs 610 extending along the lower edge of the other bra cup. The connections between the body strap 1326 and the bra 1000 are similar to those of the original configuration of FIGS. 14A-14C, and thus, detailed description thereof is omitted. FIG. 16C shows an exemplary attachment of the lower straps 1326 to the bra 1000, but the specific tabs used for attachment may vary.

4. The Asymmetrical Configuration

FIGS. 17A-17D show representative examples of the backless bra 1000 worn in the asymmetrical configuration, along with a schematic illustration of this configuration.

In the asymmetrical configuration, a halter strap 1324 and an arm strap 1322 are employed, both extending over the same shoulder as shown, along with the body strap 1326. The halter strap 1324 is used in a non-halter type fashion, that is, it is not held behind at the neck (hence, the halter straps 1324 are more appropriately called multi-functional straps).

Figure 17A:
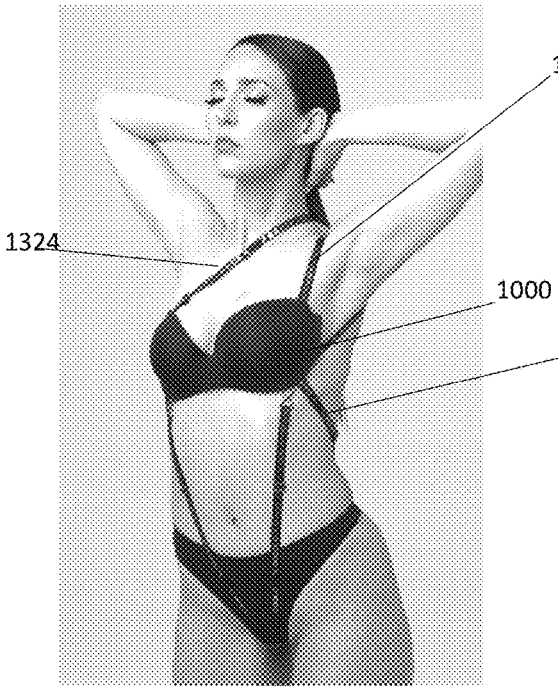
FIGS. 17A-17D show the backless bra being worn in the "Asymmetrical" configuration of FIG. 13.
Figure 17B:
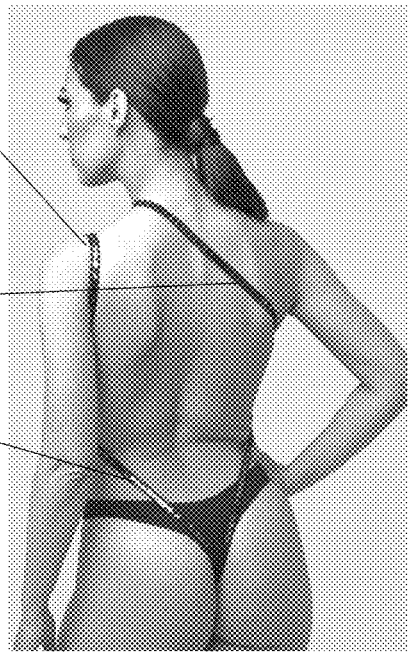
Figure 17D:
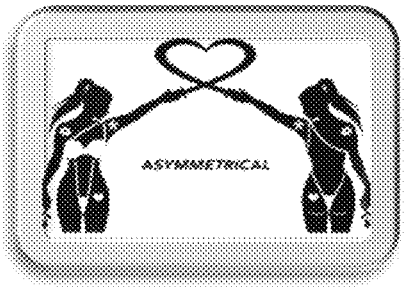
Figure 17C:
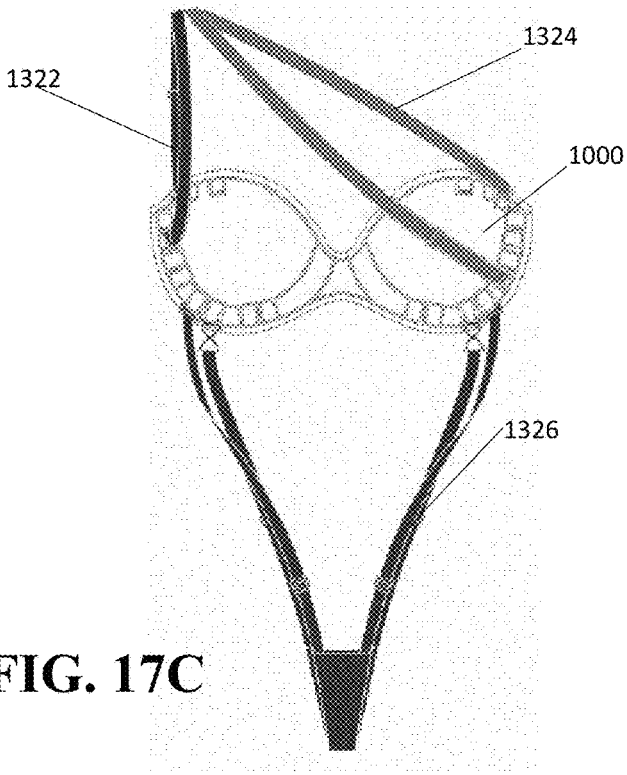

As shown in FIGS. 17A-17B, one end of the halter strap 1324 is connected to an upper tab provided along an upper edge of a respective bra cup, then extends across a wearer's chest, over the wearer's shoulder and across the wearer's back so that the second is connected to the same bra cup using either one of the upper tabs or lower tabs on the respective bra cup. The arm strap 1322 is attached to the other bra cup by coupling opposing ends of the arm strap 1322 to different tabs on the bra cup. FIG. 17C shows an exemplary attachment of the upper straps 1322, 1324 to the bra 1000, but the specific tabs used for attachment may vary. When used with a bra of FIGS. 7A-7D, the opposing ends of each arm strap 1322 may both be coupled to the corner tab 611. Alternatively, one end of the arm strap may be coupled to the corner tab 611 and the other end of the arm strap 1322 may be coupled to one of the lower tabs 610 provided along the lower edge of the bra cup, or one end of the arm strap 1322 may be coupled to an upper tab provided along the upper edge of the respective bra cup and the other end may be coupled to the corner tab 611. Similarly, when used with the bra of FIGS. 7A-7D, the opposing ends of the halter strap 1324 may both be coupled to the corner tab 611, or in some variations, one end of the halter strap 1324 may be coupled to the corner tab 611 while the other end is coupled to either one of the upper tabs or one of the lower tabs.

The connections between the body strap 1326 and the bra are similar to those of the original configuration of FIGS. 14A-14C, and thus, detailed description thereof is omitted. FIG. 17C shows an exemplary attachment of the lower strap 1326 to the bra 1000, but the specific tabs used for attachment may vary.

5. The Strapless Configuration

FIGS. 18A-18D show representative examples of the backless bra 1000 worn in the strapless configuration, along with a schematic illustration of this configuration.

In the strapless configuration, two halter (multi-functional) straps 1324 extend horizontally to support the bra arounds the wearer's chest, without the use of the body strap 1326. In a variation, a single strap 1324 can be employed. However, two straps separated by a short distance such as shown in the representative photographs herein provide better support of the breast area by the bra of the present invention.

Figure 18A:
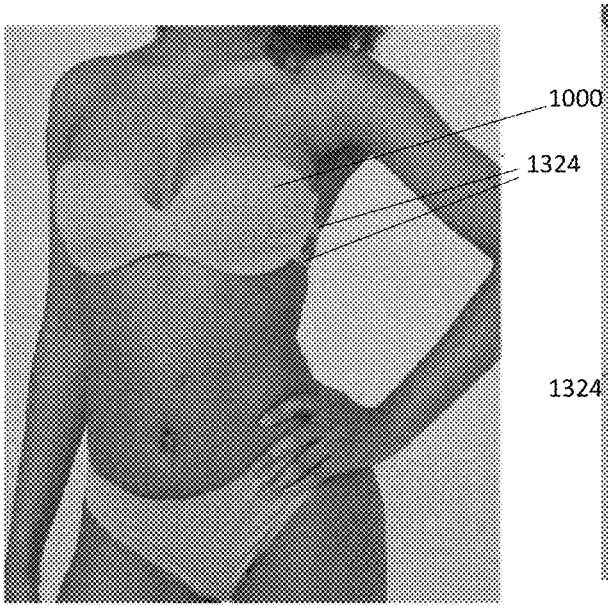
FIGS. 18A-18D show the backless bra being worn in the "Strapless" configuration of FIG. 13.
Figure 18B:
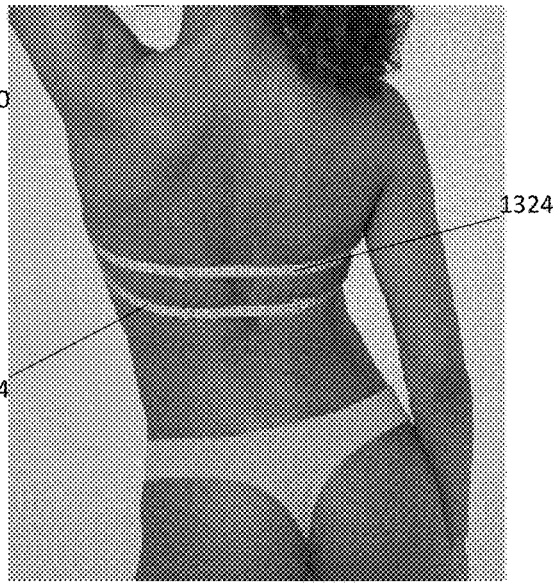
Figure 18D:
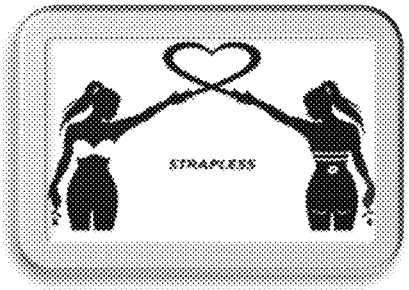
Figure 18C:
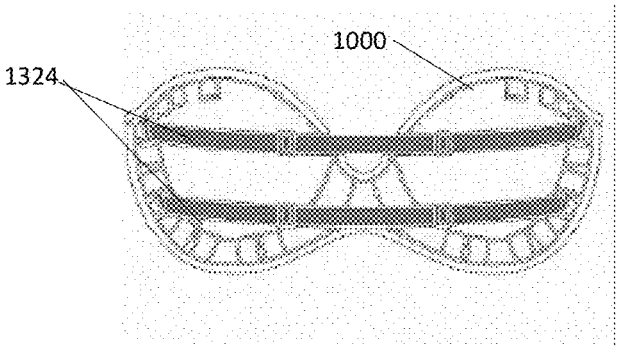

As shown in FIGS. 18A-18C, the ends of each halter strap 1324 are attached to the lower tabs provided along the lower edge of the bra cups and the tabs used for connecting to the halter straps 1324 may be varied to create a larger space or a smaller space between the straps 1324. FIG. 18C shows an exemplary attachment of the upper straps 1324 to the bra 1000, but the specific tabs used for attachment may vary. When used with the embodiment of FIGS. 7A-7D, one halter strap 1324 may be attached to the corner tabs 611 on the bra cups, while another halter strap 1324 may be attached to lower tabs 610 provided along the lower edges of the bra cups.

When the bra 1000 is worn in the strapless configuration, the wearer can adjust the location of the straps and the tension of the straps in order to create a smoother back appearance and to avoid the appearance of "back fat." These adjustments also improve support to the wearer's breasts provided by the bra 1000 and prevent the bra from sliding down when worn. Thus, the use of the straps and the adjustability of the connections between the straps and the multiple tabs on the bra, as well as the adjustability of the strap length, provide a bra that can be worn in a strapless configuration with a smoother back aesthetic (without the appearance of "back fat"), improved support and maintaining the positioning of the bra relative to the wearer's body, i.e., prevent shifting and sliding down of the bra.

6. Other Configurations

The bra 1000 of the present invention may be used in countless additional wearing configurations, which may be dictated by the clothing to be worn with the bra. FIGS. 20A-24C show some additional wearing configurations in which the bra 1000 may be worn.

Figure 20A:
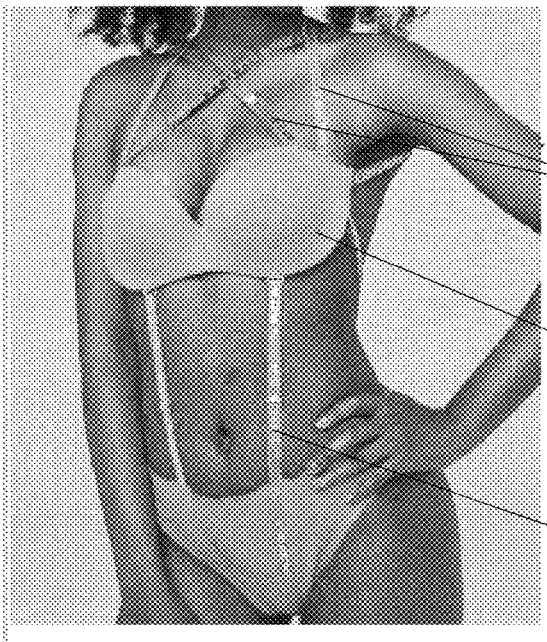
FIGS. 20A-20C show the backless bra being worn in a "Crossfront" configuration.
Figure 20B:
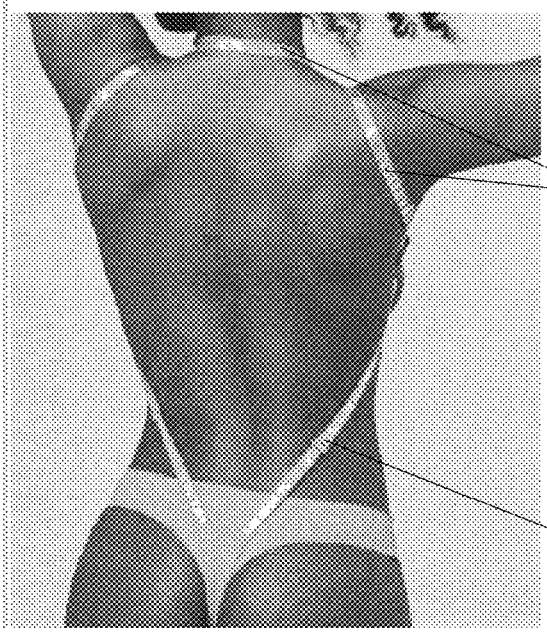
Figure 20C:
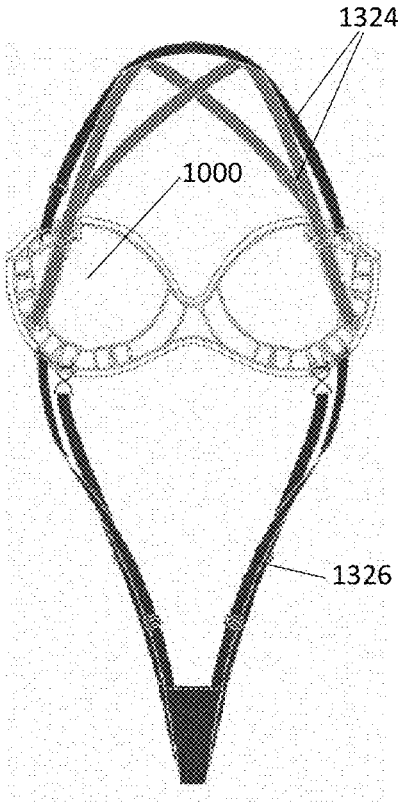

FIGS. 20A-20C show representative examples of the bra 1000 worn in a "Crossfront" configuration along with a schematic illustration of how the straps may be attached to the bra.

In the crossfront configuration of FIGS. 20A-20C, three halter straps 1324 are used together with the body strap 1326. Two of the halter straps 1324 are attached so that one end of the strap is attached to one of the upper tabs along the upper edge of one cup of the bra 1000 and an opposing end of the strap 1324 is attached to one of the lower tabs along the lower edge of another cup of the bra 1000. These two halter straps 1324 crisscross with one another in the front of a wearer's chest, as shown in FIG. 20A. A third halter strap 1324 may be used to extend around the wearer's neck for providing additional support to the wearer's breasts or for creating a specific look, and this third halter strap is attached similar to the halter strap in the halter configuration of FIGS. 15A-15D. In some wearing configurations, the third halter strap 1324 may be omitted.

The connections between the body strap 1326 and the bra are similar to those of the original configuration of FIGS. 14A-14C, and thus, detailed description thereof is omitted. FIG. 20C shows an exemplary attachment of the lower strap 1326 to the bra 1000, but the specific tabs used for attachment may vary.

Figure 21A:
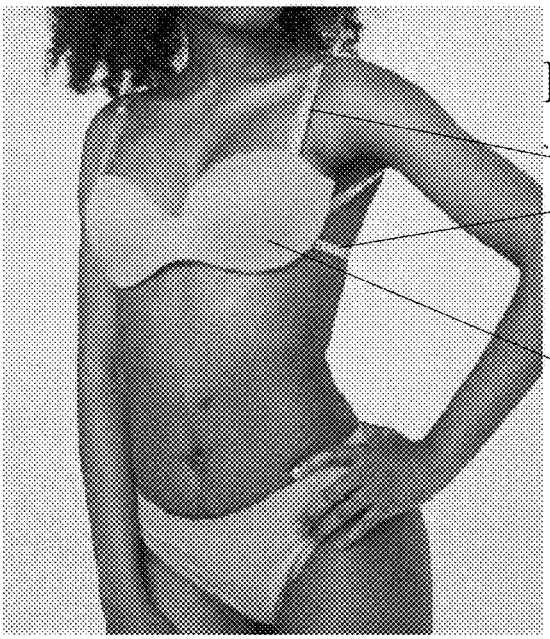
FIGS. 21A-21D show the backless bra being worn in another configuration using only upper straps.
Figure 21C:
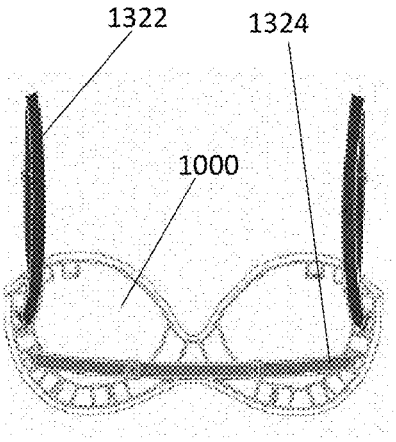
Figure 21B:
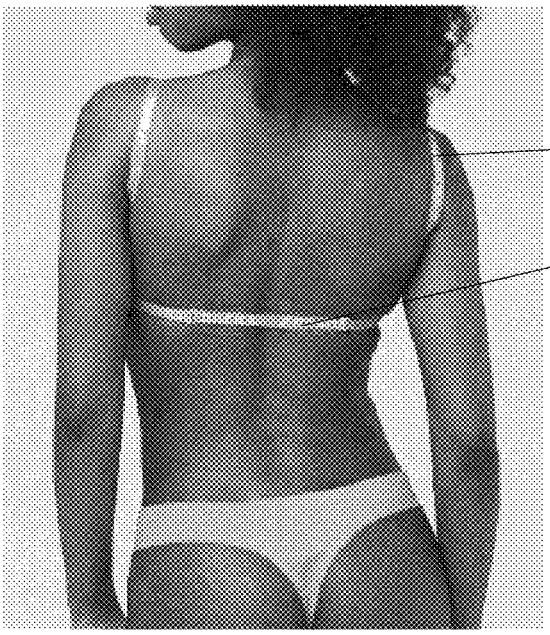
Figure 21D:
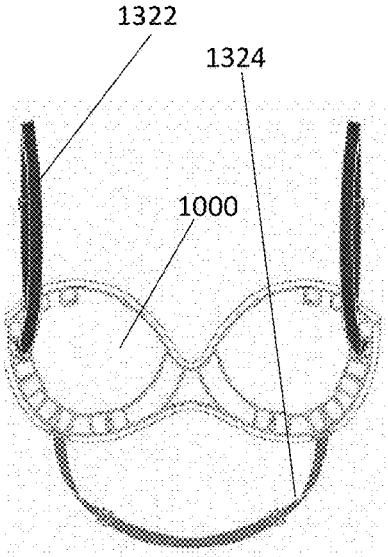

FIGS. 21A-21D show another wearing configuration of the bra 1000 of the present invention using only the upper straps. In FIGS. 21A-21D, a body strap is not used with the bra 1000, and instead only the upper straps 1322 and 1324 are used. Specifically, in FIGS. 21A-21D, arm straps 1322 are attached to the bra 1000 so as to extend around a wearer's shoulders. As shown in FIGS. 21C and 21D, the connections between the arm straps 1322 and the tabs of the bra are similar to those of the "Original" configuration in FIGS. 14A-14C. It is understood that the specific connections to the tabs may be adjusted based on the wearer's body shape. In addition, in FIGS. 21A-D, a halter strap 1324 is used to attach to the lower tabs along the lower edges of the bra and to extend around a wearer's torso. The attachment of the halter strap 1324 to the bra 1000 may be varied, as illustrated in FIG. 21C, which shows a configuration in which the halter strap 1324 extends across the wearer's back at a higher position, and FIG. 21D, which shows a configuration in which the halter strap 1324 extends across the wearer's back at a lower position to allow the bra to be worn with garments that have a more exposed back. In any case, the attachment positions of the halter strap 1324 to the bra may be adjusted based on the wearer's body shape and the garment with which the bra is to be worn.

Figure 22A:
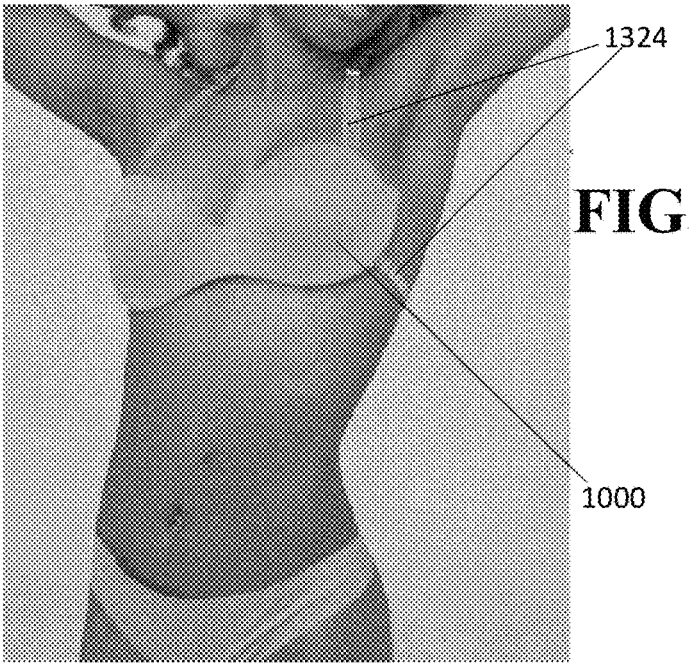
FIGS. 22A-22C show the backless bra being worn in another "Halter" configuration using only upper straps.
Figure 22C:
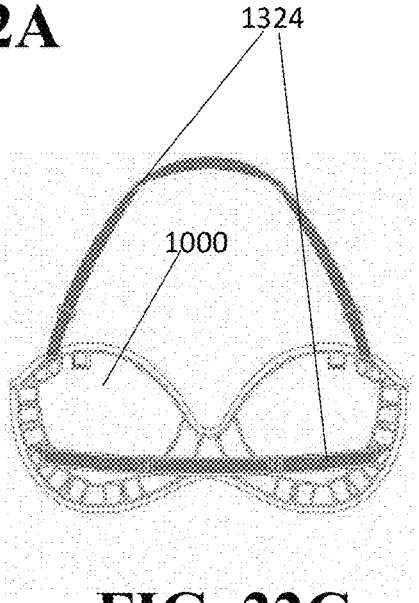
Figure 22B:
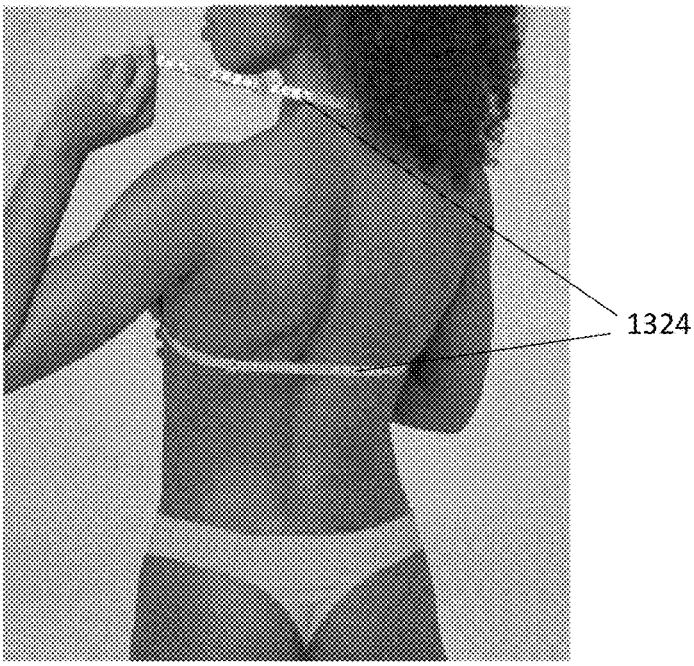

FIGS. 22A-22C show another halter wearing configuration and in FIGS. 22A-22C, the body strap is not utilized. As shown, two halter straps 1324 are connected to the bra 1000, with one halter strap connecting to the upper tabs along the upper edge of the bra so as to extend around a wearer's neck and the other halter strap connecting to the lower tabs along the lower edge of the bra so as to extend around the wearer's torso. These connections may be adjusted depending on the wearer's body shape and the garment to be worn.

Figure 23A:
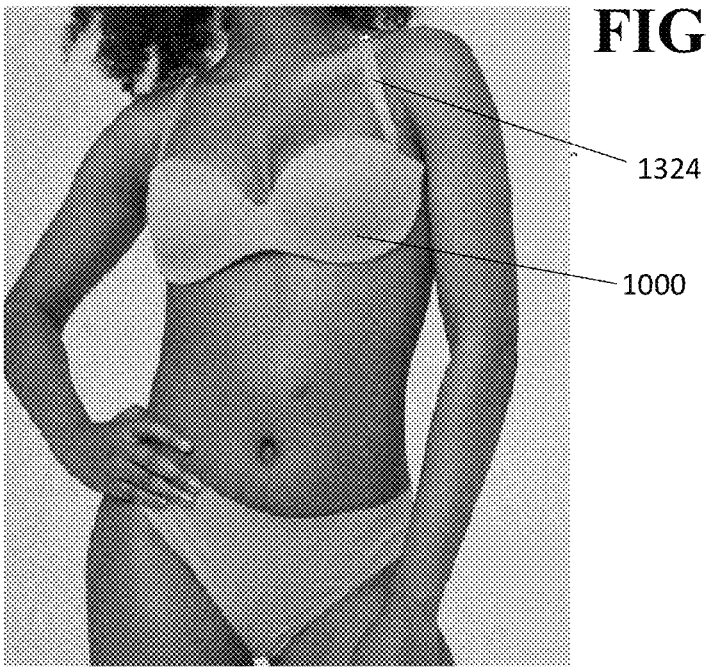
FIGS. 23A-23C show the backless bra being worn in another "Crossback" configuration using only upper straps.
Figure 23B:
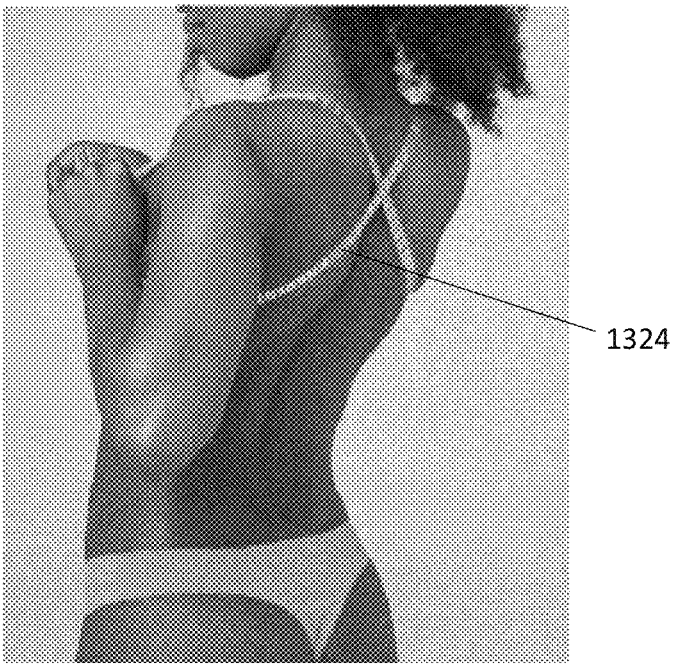
Figure 23C:
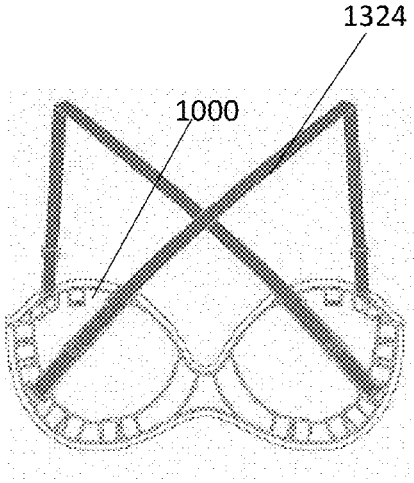

FIGS. 23A-23C show another crossback configuration and in FIGS. 23A-23C, the body strap is not utilized. As shown, two halter straps 1324 are connected to the bra in a similar way as the upper straps in FIGS. 16A-16D. As in the other configurations, these connections and the tabs used for the connections may be adjusted depending on the wearer's body shape and the garment to be worn.

FIGS. 24A-24B show another asymmetrical configuration and in FIGS. 23A-23C, the body strap is not utilized. As shown, an arm strap 1322 is connected to the bra so as to extend around a wearer's shoulder and a halter strap 1324 is connected to the bra to extend across the wearer's chest and back asymmetrically. These connections are similar to those of the arm strap 1322 and the halter strap 1324 shown in the asymmetrical configuration of FIGS. 17A-17D. In addition, in FIGS. 24A-24B, instead of the lower body strap 1326, a second halter strap 1324 is used to extend around the wearer's torso, similar to the halter strap 1324 used in FIGS. 21A-21D. As in the other configurations, these connections and the tabs used for the connections may be adjusted depending on the wearer's body shape and the garment to be worn.

Although the wearing configurations of FIGS. 19A-24C are shown with the bra of FIGS. 1, 4, 6A-6B and 12A-12B, it is contemplated that the same wearing configurations can be achieved with the bra 600 of FIGS. 7A-7D that uses trapezoidal tabs and triangular corner tabs.

In accordance with the present invention, and as described herein, the inclusion of multiple tabs within the back surface of the bra allows the wearer to connect the straps to desired tabs on the left and right sides of the bra. In one scenario, the straps are coupled to tabs adjacent to one another on the left side of the bra and likewise to tabs adjacent to one another on the right side of the bra. In this situation, the straps will be relatively close to another. In another scenario, the straps are coupled to tabs spaced at least one apart from one another thus assuring the horizontally disposed straps, when worn, do not overlap and do not make contact with one another. This is shown in the photographs of FIGS. 18A-18C. Accordingly, the positioning of the tabs on the inner surface of the bra are particularly selected to provide this aesthetic and functional outcome.

In each of the various configurations described herein and other configurations that are achievable via the present invention, the various strap ends are coupled to select tabs within the bra, such as the bras shown in FIGS. 1, 4, 6A-6B, 7A-7D and 12A-12B, to provide the best fit functionally and aesthetically. Straps coming from above generally are best attachable to tabs on or near the upper surfaces of the bra or at the corners of the bra, e.g., corner tabs. Similarly, straps coming from below the bra generally are best attachable to tabs on or near the lower surfaces of the bra. Straps coming from the sides can be attachable to either upper or lower tabs, generally closer to the outer side edges of the bra, or to the corner tabs provided at the corners of the bra.

However, the location of the most appropriate tabs to connect the straps also may take into account relative position of the ends of each strap and the angles of the straps as they approach the bra. In some configurations, the straps are relatively vertical, that is, extend mostly up and down (with little to no slant). This includes at least the shoulder straps in the original configuration. In other configurations, the straps extend toward the bra at a relatively large angle, such as the halter strap in halter configuration, and at least one of the multi-functional strap in the asymmetrical configuration.

Selection of the inner tabs or the tabs near or at the left-most and right-most tabs on the bra may be a function of the relative angles of the straps. Other factors that may impact the selection of the most appropriate tab to connect a strap include the relative dimensions of the wearer, the relative size of the backless bra being worn, the shape of the wearer, among other physical factors. This includes both the body strap extending upwards to the bra and the shoulder or halter straps extending downward to the bra.

Accordingly, the present invention advantageously enables each wearer to select the best tabs on the bra to attach the various straps. Clearly, humans don't have the exact same body shape and size. Instead, body shapes and sizes may vary significantly from person to person, and the backless bra of the present invention provides a backless bra designed to be worn in any one of a number of multiple configurations and to simultaneously accommodate the distinct sizes and shapes of its wearer. Even though the backless bra of the present invention is available in different sizes, the wearer's body structure may impact which tabs are employed. Moreover, selection of specific tabs may be adjusted in order to allow the straps to lay flat against a wearer's body. Again, this selection is dictated by different body shapes and the use of multiple tabs positioned in different locations of the inner surface of the bra allows for a better fit of the bra for different body shapes.

Figure 25A:
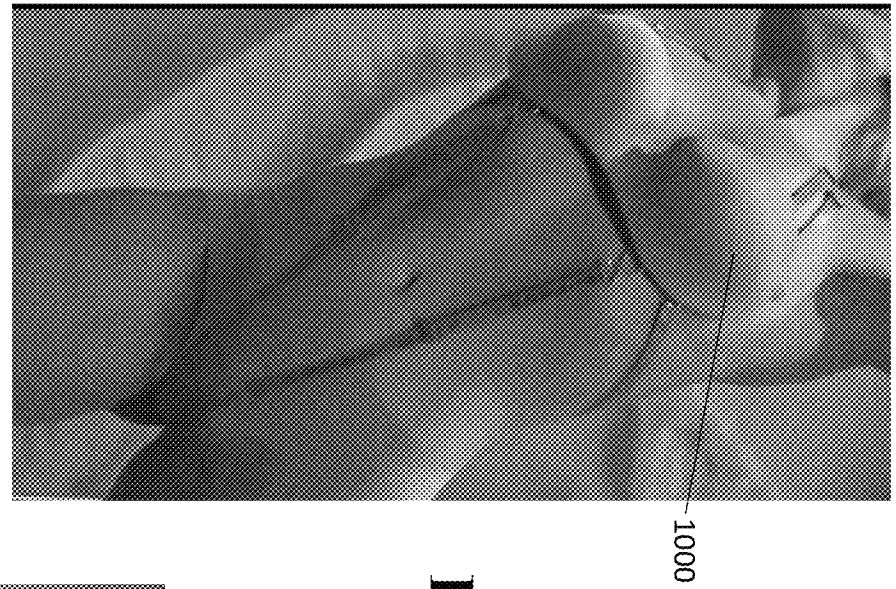
FIGS. 25A-25B show the backless bra being worn during movement of the wearer.
Figure 25B:
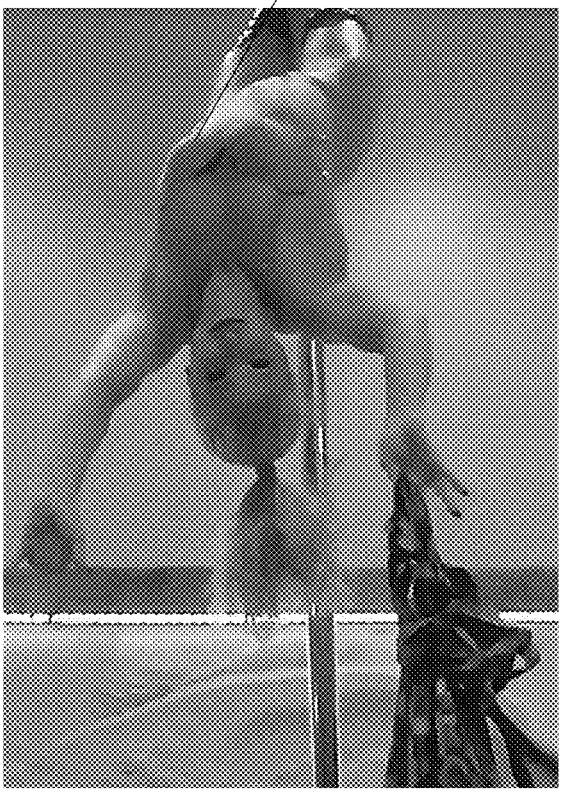

Another significant improvement achieved by the bra of the present invention is the ability of the bra to stay in place relative to the wearer's body during movements, even with unusual movements of the wearer, such as in upside-down positions. FIGS. 25A-25B show the bra 1000 of the present invention worn by a person during various movements and demonstrate the ability of the bra 1000 to stay in place while the person is moving.

Upgradeability and Additional Variations of the Invention

The present invention has been described in terms of a number of embodiments and variations thereof. Drawings and photographs showing representative embodiments, representative components and representative configurations are presented herein.

The present invention further comprises the possibility of upgrading the backless bra by obtaining a different set of straps having different designs, shapes, materials and/or other aesthetic and/or structural (e.g., strength) characteristics. Such upgraded straps may include the same hardware or different hardware of the originally provided straps. In one version, the hardware, that is, the hooks and/or sliders, coupled to the new straps is aesthetically and/or functionally distinct from the originally provided hardware. Distinct jewelry within these components may be desirable and thus the present invention enables for the upgrade of such jewelry within the herein-described invention.

The bra itself may be upgraded, if desired. In accordance with the present invention, the materials, design, shape, size and other characteristics of an upgraded bra may be different than the originally provided bra. In addition, overlays to change the appearance of the bra cups may be provided, wherein an overlay may attach to the outer surface of the bra using suitable fasteners, such as zippers, snaps, hook and loop fasteners and other fasteners. The overlays may include decorative elements, such as beading or crystals or embroidery. This allows a wearer to change the appearance of the bra depending on the wearer's needs and desires and to upgrade the appearance of the bra. Moreover, the locations, as well as the shape or size of the tabs may be different to enable the wearer to experiment with connections of the straps that differ from those provided by the originally obtained bra.

The straps of the present invention also may be distinctly different from those shown in the figures. For instance, the straps may be made of a variety of materials and have any appropriate design thereon, and may have different shapes, and/or have other different aesthetic and functional characteristics than herein described. Functional characteristics not related to aesthetic may include strength, elasticity, comfort, ability to wick away moisture (e.g., perspiration), be manufactured from non-allergic type materials, and other characteristics known in the art. The bras described above may be used with many different straps and the straps may be interchangeable. In addition, straps of different stretchability or elasticity may be used with the above-described bras in order to customize support provided by the bra. In some embodiments, the straps do not use sliders to adjust the length of the straps, and instead, the straps are made from materials having higher elasticity so as to provide a better fit, without using a length adjustment mechanism. Moreover, straps extensions may be provided in order to customize the length of some or all of the straps.

The hardware and/or the manner of interconnection of the straps to the bra may be different than that shown and described herein. Different types of connectors and devices to adjust the lengths of the straps may be employed. As mentioned above, a length adjustment mechanism with sliders may be omitted and the straps may instead be made from a more elastic material. Moreover, rather than using tabs within the bra such as described and shown herein, the present invention may employ a different attachment device or methodology within the bra itself. For instance, the bra may include non-removable hardware, such as rings or other connecting-type devices, to facilitate connection to the ends of each of the straps. Other appropriate connection systems and methodologies may be employed.

Moreover, as previously mentioned, the number and position of the tabs, i.e., connection points, of the bra may differ than that shown herein. Based on function, comfort, and aesthetics, the positions of the tabs can be modified to impart distinctly different looks of straps extending from the bra of the present invention.

In yet further additional variations of the present invention, integrated thong, fully-panty or other appropriate components coupled to the body strap may be employed.

The bras and tabs of the present invention may also be adapted for use in exterior clothing and athletic wear. For example, a bra may be modified to be used as clothing rather than underwear and may include tabs or other fasteners for attachment of straps and/or other clothing elements thereto. Furthermore, clothing items, such as crop-tops and the like may be modified to include tabs for attaching straps and other clothing elements thereto in order to customize the appearance of the clothing items.

Any and all of the embodiments described herein may employ other variations of its various components. For instance, there are countless cup shapes, designs and/or constructions, and all, nearly all, or at least many of such versions, may be employed within many, if not all, of the herein described embodiments of the backless bra of the present invention. Moreover, even though the bras shown in the figures include a bridge or center gore, it is also contemplated that the two cups may be separate from one another and that the straps may be used for providing sufficient support and keeping the separated bra cups in place when worn.

While the invention has been shown and described with reference to certain embodiments of the present invention thereof, it will be understood by those skilled in the art that various changes in from and details may be made therein without departing from the spirit and scope of the present invention and equivalents thereof.

I claim:

1. A bra comprising:

a first cup and a second cup, each of the first and second cups having an outer surface and an inner surface, the inner surface facing a wearer's skin when worn, and each of the first and second cups having an upper edge and a lower edge;

a plurality of tabs provided on the inner surface of the first and second cups, each of the tabs being configured for connecting at least one fastener portion thereto, wherein the plurality of tabs include one or more lower tabs formed along the lower edge of the first cup and one or more lower tabs formed along the lower edge of the second cup; and wherein each of the lower tabs is formed from a pair of loops angled relative to one another and partially overlapping with one another at one end thereof.

2. The bra in accordance with claim 1, wherein each of the lower tabs includes a first end attached adjacent to the lower edge of the respective first and second cup and a second end attached at a predetermined distance away from the lower edge, and wherein each of the upper tabs forms a loop.

3. The bra in accordance with claim 2, wherein each of the first and second bra cups includes an underwire extending along the lower edge of the respective first and second cup within an underwire channel, and wherein each of said lower tabs extends across the underwire channel.

4. The bra in accordance with claim 1, wherein:

each of the first and second bra cups includes an outer side corner, and the plurality of tabs include first and second corner tabs formed adjacent to the outer side corners of the respective first and second bra cups, each of said first and second corner tabs being configured for connecting at least one fastener portion thereto and being configured to enable said at least one fastener portion to pivot between first and second orientations.

5. The bra in accordance with claim 1, wherein:

each of the first and second bra cups includes at least first, second and third lower tabs disposed along the lower edge of the respective first and second bra cup;

the first lower tab is adjacent to the second lower tab and the second lower tab is adjacent to the third lower tab; and a first distance between the first lower tab and the second lower tab is different from a second distance between the second lower tab and the third lower tab.

6. The bra in accordance with claim 1, wherein the plurality of tabs include one or more upper tabs formed along the upper edge of the first cup and one or more upper tabs formed along the upper edge of the second cup.

7. The bra in accordance with claim 6, wherein the lower tabs and the upper tabs have the same construction.

8. The bra in accordance with claim 6, wherein:

each of the first and second bra cups includes at least first, second and third upper tabs disposed along the upper edge of the respective first and second bra cup;

the first upper tab is adjacent to the second upper tab and the second upper tab is adjacent to the third upper tab; and a first distance between the first upper tab and the second upper tab is different from a second distance between the second upper tab and the third upper tab.

9. The bra in accordance with claim 1, wherein the bra does not include side panels or a backband extending from the bra cups, and the bra is configured to provide an unobstructed view of a wearer's back.

10. A bra assembly comprising:

the bra in accordance with claim 1; and a body strap including first and second lower straps, wherein each of the first and second lower straps includes at least one fastener portion configured to connect with the one or more lower tabs.

11. The bra assembly in accordance with claim 10, wherein:

the plurality of tabs include at least one of: (a) one or more upper tabs formed along the upper edge of the first cup and one or more upper tabs formed along the upper edge of the second cup; and (b) first and second corner tabs formed adjacent to outer side corners of the respective first and second bra cups; and the bra assembly further includes one or more upper straps, each of said upper straps including at least one fastener portion configured to connect with the at least one of the one or more upper tabs and the first and second corner tabs.

12. The bra assembly in accordance with claim 11, wherein the body strap and the one or more upper straps are configured to connect to selected tabs of the plurality of tabs to form different wearing configurations of the bra assembly.

13. A bra comprising:

a first cup and a second cup, each of the first and second cups having an outer surface and an inner surface, the inner surface facing a wearer's skin when worn, and each of the first and second cups having an upper edge and a lower edge; and a plurality of tabs provided on the inner surface of the first and second cups, each of the tabs being configured for connecting at least one fastener portion thereto, wherein:

each of the first and second bra cups includes an outer side corner, and the plurality of tabs include first and second corner tabs formed at the outer side corners of the respective first and second bra cups.

14. The bra in accordance with claim 13, wherein each of said first and second corner tabs is configured for connecting at least one fastener portion thereto and is configured to enable said at least one fastener portion to pivot between first and second orientations.

15. The bra in accordance with claim 14, wherein each corner tab includes a strap portion having first and second ends attached at the respective outer side corner and angled relative to one another at an angle greater than 0 degrees and smaller than 180 degrees.

16. The bra in accordance with claim 14, wherein each corner tab includes a first strap portion attached adjacent to the respective outer side corner and a second strap portion folded over at least a portion of the first strap portion to form a first loop portion, and wherein a free end of the second strap portion is attached to the bra cup so as to form a second loop portion oriented in a different direction from the first loop portion.

17. The bra in accordance with claim 16, wherein the plurality of tabs include one or more lower tabs formed along the lower edge of the first cup and one or more lower tabs formed along the lower edge of the second cup.

18. A bra assembly comprising:

the bra in accordance with claim 13;

one or more upper straps, each of said upper straps including at least one fastener portion configured to connect with one of the first and second corner tabs.

19. The bra assembly in accordance with claim 18, wherein the plurality of tabs include one or more lower tabs formed along the lower edge of the first cup and one or more lower tabs formed along the lower edge of the second cup, and wherein the bra assembly further includes a body strap including first and second lower straps, each of the first and second lower straps including at least one fastener portion configured to connect with the one or more lower tabs.

20. The bra assembly in accordance with claim 19, wherein the body strap and the one or more upper straps are configured to connect to selected tabs of the plurality of tabs to form different wearing configurations of the bra assembly.

21. The bra in accordance with claim 1, wherein each of the lower tabs comprises a first end and a second end, said first end and said second end being disposed at different locations with respect to the inner surface of each of the first and second cups.

22. The bra in accordance with claim 1, wherein each of the lower tabs is formed by folding a strap or a ribbon at an angle, with both ends of the strap being attached adjacent to the lower edge of the first cup and the second cup.

23. A bra assembly comprising:

a first cup and a second cup, each of the first and second cups having an outer surface and an inner surface, the inner surface facing a wearer's skin when worn, and each of the first and second cups having an upper edge and a lower edge;

a plurality of tabs provided on the inner surface of the first and second cups, each of the tabs being configured for connecting at least one fastener portion thereto; and a body strap including first and second lower straps, wherein the plurality of tabs include one or more lower tabs formed along the lower edge of the first cup and one or more lower tabs formed along the lower edge of the second cup; and wherein each of the first and second lower straps includes at least one fastener portion configured to connect with the one or more lower tabs; and wherein the body strap further includes a gusset connecting portions of the first and second lower straps.

24. A bra assembly comprising:

a first cup and a second cup, each of the first and second cups having an outer surface and an inner surface, the inner surface facing a wearer's skin when worn, and each of the first and second cups having an upper edge and a lower edge;

a plurality of tabs provided on the inner surface of the first and second cups, each of the tabs being configured for connecting at least one fastener portion thereto; and a plurality of body straps;

wherein the plurality of tabs include one or more lower tabs formed along the lower edge of the first cup and one or more lower tabs formed along the lower edge of the second cup; and wherein the body straps are attachable to different sets of the tabs, so that the bra assembly can be worn by the user in the following configurations:

a) a Shoulder Strap configuration, b) a Halter configuration; and c) a Crossback configuration.

* * * * *